US012703938B2

(12) United States Patent
Hong et al.

(10) Patent No.: US 12,703,938 B2
(45) Date of Patent: Aug. 11, 2026

(54) CLOTHES TREATING APPARATUS

(71) Applicant: SAMSUNG ELECTRONICS CO., LTD., Suwon-si (KR)

(72) Inventors: Jaewan Hong, Suwon-si (KR); Dongpil Seo, Suwon-si (KR); Taehyun Sung, Suwon-si (KR); Kanghyun Lee, Suwon-si (KR); Jaebok Lee, Suwon-si (KR); Youngjin Cho, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 79 days.

(21) Appl. No.: 18/612,063

(22) Filed: Mar. 21, 2024

(65) Prior Publication Data

US 2024/0417911 A1 Dec. 19, 2024

Related U.S. Application Data

(63) Continuation of application No. PCT/KR2024/003285, filed on Mar. 15, 2024.

(30) Foreign Application Priority Data

Jun. 19, 2023 (KR) ..... 10-2023-0078550

(51) Int. Cl.
*D06F 39/10* (2006.01)
*D06F 37/20* (2006.01)
(Continued)

(52) U.S. Cl.
CPC ..... *D06F 39/10* (2013.01); *D06F 37/20* (2013.01); *D06F 39/083* (2013.01); *D06F 39/12* (2013.01)

(58) Field of Classification Search
CPC ..... D06F 37/20; D06F 39/12; D06F 39/10; D06F 39/083
See application file for complete search history.

(56) References Cited

U.S. PATENT DOCUMENTS 4,660,393 A * 4/1987 Yanagihara ..... D06F 39/088 210/171
12,331,448 B2 6/2025 Root et al.
(Continued)

FOREIGN PATENT DOCUMENTS

CN 101363183 A 2/2009
CN 105986428 A 10/2016
(Continued)

OTHER PUBLICATIONS

International Search Report dated Jul. 12, 2024 issued in PCT Application No. PCT/KR2024/003285.
(Continued)

*Primary Examiner* — Joseph L. Perrin
(74) *Attorney, Agent, or Firm* — STAAS & HALSEY LLP

(57) ABSTRACT

A clothes treating apparatus includes a housing, a tub inside the housing, a drainage device configured to discharge water from the tub to an outside of the housing; a filter device configured to be disposed outside the housing and connected to the drainage device to receive water discharged by the drainage device and filter out foreign substances from the received water, the filter device including a coupler on a bottom of the filter device; and an installation device configured to mount the filter device to a surface, the installation device including a supporter, and the supporter including a supporter mounting portion, wherein the installation device is configured so that the supporter is seatable to the surface, and the supporter mounting portion is couplable to the coupler so that, while the supporter is seated to the surface and the supporter mounting portion is coupled to the coupler, the filter device is mounted to the surface.

20 Claims, 21 Drawing Sheets

(51) Int. Cl.
*D06F 39/08* (2006.01)
*D06F 39/12* (2006.01)

(56) References Cited

U.S. PATENT DOCUMENTS

| | | | | |
|---|---|---|---|---|
| 2005/0205482 | A1 | 9/2005 | Gladney | |
| 2023/0124777 | A1* | 4/2023 | Roetker | D06F 23/025 68/12.02 |
| 2023/0212809 | A1 | 7/2023 | Cho et al. | |

FOREIGN PATENT DOCUMENTS

| | | | | |
|---|---|---|---|---|
| CN | 218166206 | U | 12/2022 | |
| EP | 4 190 964 | A1 | 6/2023 | |
| JP | 7-217181 | | 8/1995 | |
| JP | 2017-164725 | | 9/2017 | |
| KR | 20-1995-0082802 | | 4/1995 | |
| KR | 2003-0021052 | | 3/2003 | |
| KR | 10-1182926 | | 9/2012 | |
| KR | 10-2017-0051977 | | 5/2017 | |
| KR | 10-1753302 | | 7/2017 | |
| KR | 10-1847124 | | 4/2018 | |
| KR | 10-2021-0125178 | | 10/2021 | |
| KR | 20-2022-0000722 | | 3/2022 | |
| KR | 10-2022-0043935 | | 4/2022 | |
| KR | 10-2022-0110560 | | 8/2022 | |
| WO | WO-9414361 | A1 * | 7/1994 | A47G 11/00 |
| WO | WO 2023/237200 | A1 | 12/2023 | |

OTHER PUBLICATIONS

Written Opinion dated Jul. 12, 2024 issued in PCT Application No. PCT/KR2024/003285.
Extended European Search Report dated Apr. 20, 2026 for European Application No. 24826071.3.

* cited by examiner

CLOTHES TREATING APPARATUS

CROSS-REFERENCE TO RELATED APPLICATIONS

This application is a continuation application, under 35 U.S.C. § 111(a), of International Application No. PCT/KR2024/003285, filed on Mar. 15, 2024, which claims priority under 35 U.S.C. § 119 to Korean Patent Application 10-2023-0078550, filed on Jun. 19, 2023, in the Korean Intellectual Property Office, the disclosures of which are incorporated by reference herein in their entireties.

TECHNICAL FIELD

The present disclosure relates to a clothes treating apparatus including a filter device and a washing machine.

BACKGROUND ART

A washing machine is a device that uses a driving force of a drive motor to agitate laundry, water, and detergent, which are put into a tub together, so as to wash the laundry through mutual friction.

Operations performed by the washing machine may include a washing operation in which detergent and water are supplied to the tub storing the laundry and the laundry is rotated while the drum is rotated, a rinsing operation in which water is supplied to the tub and the drum is rotated to rinse the laundry, and a spin-drying operation in which water is discharged from the tub and the drum is rotated to remove moisture from the laundry.

The washing machine may include a drainage device configured to discharge water in the tub to the outside of the washing machine when performing the washing operation, the rinsing operation, and/or the spin-drying operation. The drainage device may be configured to discharge water, which is discharged from the tub, back into the tub when performing the washing operation and/or the rinsing operation.

DISCLOSURE

Technical Problem

It is an object of the present disclosure to provide a clothes treating apparatus with improved installation efficiency of a filter device.

It is an object of the present disclosure to provide a clothes treating apparatus with improved usability of a filter device.

Technical tasks to be achieved in this document is not limited to the technical tasks mentioned above, and other technical tasks not mentioned will be clearly understood by those skilled in the art from the description below.

Technical Solution

According to an embodiment of the disclosure, a clothes treating apparatus includes a housing, a tub inside the housing, a drainage device configured to discharge water from the tub to an outside of the housing; a filter device configured to be disposed outside the housing, and connected to the drainage device to receive the water discharged by the drainage device and filter out foreign substances from the received water, the filter device including a coupler on a bottom of the filter device; and an installation device configured to mount the filter device to a surface, the installation device including a supporter, and the supporter including a supporter mounting portion. The installation device is configured so that: the supporter is seatable to the surface, and the supporter mounting portion is couplable to the coupler so that, while the supporter is seated to the surface and the supporter mounting portion is coupled to the coupler, the filter device is mounted to the surface.

According to an embodiment of the disclosure, a clothes treating apparatus includes a washing machine including a washing machine housing, a tub arranged inside the washing machine housing, and a drainage device configured to discharge water of the tub to an outside of the washing machine housing; a filter device disposed outside the washing machine housing, and configured to be connected to the drainage device to filter out foreign substances from water discharged from the washing machine; and an installation device provided to mount the filter device. The installation device includes a support bracket configured to be removably coupled to the filter device, and a supporter configured to be removably mounted on the support bracket and configured to be removably mounted on the filter device.

DESCRIPTION OF DRAWINGS

These and/or other aspects of the disclosure will become apparent and more readily appreciated from the following description of embodiments, taken in conjunction with the accompanying drawings of which.

MODES OF THE INVENTION

Figure 1:
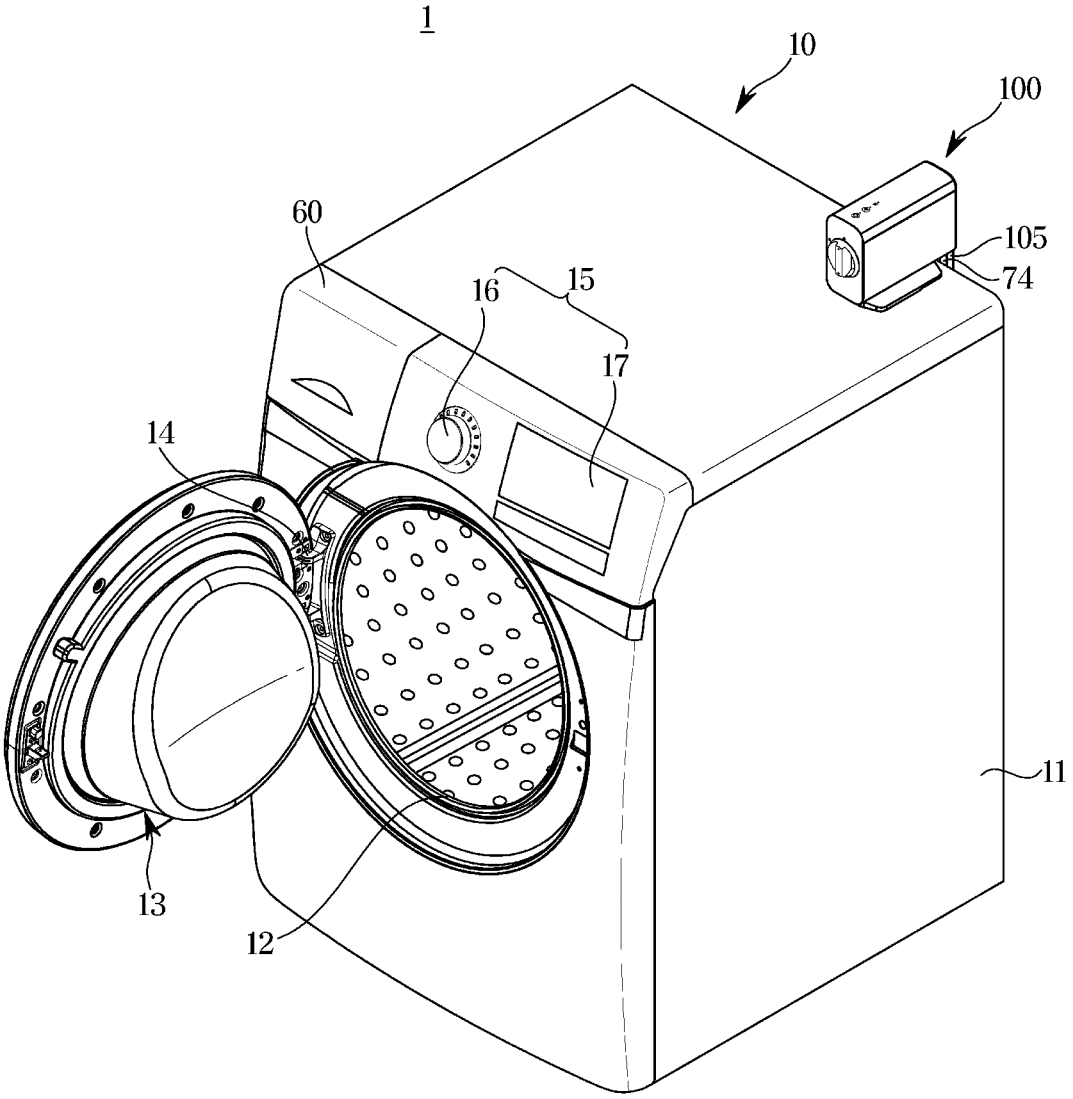
FIG. 1 illustrates a clothes treating apparatus according to an embodiment of the disclosure.

Various embodiments and terms in this document are not intended to limit the technical features described in this document to specific embodiments, and should be understood to include various modifications, equivalents, or substitutes of the embodiments.

In connection with the description of the drawings, like reference numbers may be used for like or related elements.

The singular form of a noun corresponding to an item may include one item or a plurality of items, unless the relevant context clearly dictates otherwise.

In this document, each of phrases such as "A or B," "at least one of A and B," "at least one of A or B," "A, B or C," "at least one of A, B and C," and "at least one of A, B, or C" may include any one of the items listed together in the corresponding one of the phrases, or all possible combinations thereof.

The term "and/or" includes any combination of a plurality of related components or any one of a plurality of related components.

Terms such as "first," "second," "primary," and "secondary" may simply be used to distinguish a given component from other corresponding components, and do not limit the corresponding components in any other respect (e.g., importance or order).

When any (e.g., first) component is referred to as being "coupled" or "connected" to another (e.g., second) component with or without the terms "functionally" or "communicatively", this means that the any component may be connected to the other component directly (e.g., by a wire), wirelessly, or through a third component.

The terms "comprises" and "has" are intended to indicate that there are features, numbers, steps, operations, components, parts, or combinations thereof described in this document, and do not exclude the presence or addition of one or more other features, numbers, steps, operations, components, parts, or combinations thereof.

When any component is referred to as being "connected", "coupled", "supported" or "in contact" with another component, this includes a case in which the components are indirectly connected, coupled, supported, or in contact with each other through a third component as well as directly connected, coupled, supported, or in contact with each other.

When any component is referred to as being located "on" or "over" another component, this includes not only a case in which any component is in contact with another component but also a case in which another component is present between the two components.

A washing machine according to various embodiments may perform washing, rinsing, dewatering, and drying processes. A washing machine is an example of a clothes treating apparatus, and the clothes treating apparatus is a concept encompassing an apparatus for washing clothes (objects to be washed, objects to be dried), an apparatus for drying clothes, and an apparatus capable of washing and drying clothes.

A washing machine according to various embodiments may include a top-loading washing machine in which a laundry inlet for putting in or taking out laundry is provided to face upward, or a front-loading washing machine in which a laundry inlet is provided to face forward. A washing machine according to various embodiments may include a washing machine of another loading method other than a top-loading washing machine and a front-loading washing machine.

In the case of a top-loading washing machine, laundry may be washed using a water current occurred by a rotating body such as a pulsator. In the case of a front-loading washing machine, laundry may be washed by rotating a drum to repeatedly raise and drop laundry. The front-loading washing machine may include a drying combined washing machine capable of drying laundry accommodated inside a drum. The drying combined washing machine may include a hot air supply device for supplying high-temperature air into the drum and a condensing device for removing moisture from air discharged from the drum. For example, the drying combined washing machine may include a heat pump device. A washing machine according to various embodiments may include a washing machine using a washing method other than the above-described washing method.

The washing machine according to various embodiments may include a housing accommodating various components therein. The housing may be provided in the form of a box including a laundry inlet on one side thereof.

The washing machine may include a door for opening and closing the laundry inlet. The door may be rotatably mounted to the housing by a hinge. At least a portion of the door may be transparent or translucent to allow the inside of the housing to be visible.

The washing machine may include a tub arranged inside the housing to store water. The tub may be formed in a substantially cylindrical shape with a tub opening formed at one side thereof. The tub may be disposed inside the housing in such a way that the tub opening corresponds to the laundry inlet.

The tub may be connected to the housing by a damper. The damper may absorb vibration generated when the drum rotates, and the damper may reduce vibration transmitted to the housing.

The washing machine may include a drum provided to accommodate laundry.

The drum may be disposed inside the tub in such a way that a drum opening provided at one side of the drum corresponds to the laundry inlet and the tub opening. Laundry may pass through the laundry inlet, the tub opening, and the drum opening, sequentially and then be accommodated in the drum or withdrawn from the drum.

The drum may perform each operation according to washing, rinsing, and/or spin-drying while rotating inside the tub. A plurality of through holes may be formed in a cylindrical wall of the drum to allow water stored in the tub to be introduced into or to be discharged from the drum.

The washing machine may include a driving device configured to rotate the drum. The driving device may include a drive motor and a rotating shaft for transmitting a driving force generated by the drive motor to the drum. The rotating shaft may penetrate the tub to be connected to the drum.

The driving device may perform respective operations according to washing, rinsing, and/or spin-drying, or drying processes by rotating the drum in a forward or reverse direction.

The washing machine may include a water supply device configured to supply water to the tub. The water supply device may include a water supply pipe and a water supply valve disposed in the water supply pipe. The water supply pipe may be connected to an external water supply source. The water supply pipe may extend from an external water supply source to a detergent supply device and/or the tub. Water may be supplied to the tub through the detergent supply device. Alternatively, water may be supplied to the tub without passing through the detergent supply device.

The water supply valve may open or close the water supply pipe in response to an electrical signal of a controller. The water supply valve may allow or block the supply of water to the tub from an external water supply source. The water supply valve may include a solenoid valve configured to open and close in response to an electrical signal.

The washing machine may include the detergent supply device configured to supply detergent to the tub. The detergent supply device may include a manual detergent supply device that requires a user to input detergent to be used for each washing, and an automatic detergent supply device that stores a large amount of detergent and automatically inputs a predetermined amount of detergent during washing. The detergent supply device may include a detergent box for storing detergent. The detergent supply device may be configured to supply detergent into the tub during a water supply process. Water supplied through the water supply pipe may be mixed with detergent via the detergent supply device. Water mixed with detergent may be supplied into the tub. Detergent is used as a term including detergent for pre-washing, detergent for main washing, fabric softener, bleach, etc., and the detergent box may be partitioned into a storage region for the pre-washing detergent, a storage region for the main washing detergent, a storage region for the fabric softener, and a storage region for the bleach.

The washing machine may include a drainage device configured to discharge water contained in the tub to the outside. The drainage device may include a drain pipe extending from a bottom of the tub to the outside of the housing, a drain valve disposed on the drain pipe to open and close the drain pipe, and a pump disposed on the drain pipe. The pump may pump water from the drain pipe to the outside of the housing.

The washing machine may include a control panel disposed on one side of the housing. The control panel may provide a user interface for interaction between a user and the washing machine. The user interface may include at least one input interface and at least one output interface.

The at least one input interface may convert sensory information received from a user into an electrical signal.

The at least one input interface may include a power button, an operation button, a course selection dial (or a course selection button), and a washing/rinsing/spin-drying setting button. The at least one input interface may include a tact switch, a push switch, a slide switch, a toggle switch, a micro switch, a touch switch, a touch pad, a touch screen, a jog dial, and/or a microphone.

The at least one output interface may visually or audibly transmit information related to the operation of the washing machine to a user.

For example, the at least one output interface may transmit information related to a washing course, operation time of the washing machine, and washing/rinsing/spin-drying settings to the user. Information about the operation of the washing machine may be output through a screen, an indicator, or voice. The at least one output interface may include a Liquid Crystal Display (LCD) panel, a Light Emitting Diode (LED) panel, or a speaker.

The washing machine may include a communication module for wired and/or wireless communication with an external device.

The communication module may include at least one of a short-range communication module and a long-range communication module.

The communication module may transmit data to an external device (e.g., a server, a user device, and/or a home appliance) or receive data from the external device. For example, the communication module may establish communication with a server and/or a user device and/or a home appliance, and transmit and receive various types of data.

For the communication, the communication module may establish a direct (e.g., wired) communication channel or a wireless communication channel between external devices, and support the performance of the communication through the established communication channel. According to an embodiment, the communication module may include a wireless communication module (e.g., a cellular communication module, a short-range wireless communication module, or a global navigation satellite system (GNSS) communication module) or a wired communication module (e.g., a local area network (LAN) communication module, or a power line communication module). Among these communication modules, the corresponding communication module may communicate with an external device through a first network (e.g., a short-range wireless communication network such as Bluetooth, wireless fidelity (Wi-Fi) direct, or infrared data association (IrDA)) or a second network (e.g., a long-range wireless communication network such as a legacy cellular network, a 5G network, a next-generation communication network, the Internet, or a computer network (e.g., LAN or WAN). These various types of communication modules may be integrated as one component (e.g., a single chip) or implemented as a plurality of separate components (e.g., multiple chips).

The short-range wireless communication module may include a Bluetooth communication module, a Bluetooth Low Energy (BLE) communication module, a near field communication module, a WLAN (Wi-Fi) communication module, and a Zigbee communication module, an infrared data association (IrDA) communication module, a Wi-Fi Direct (WFD) communication module, an ultrawideband (UWB) communication module, an Ant$^+$ communication module, a microwave (uWave) communication module, etc., but is not limited thereto.

The long-range wireless communication module may include a communication module that performs various types of long-range wireless communication, and may include a mobile communication circuitry. The mobile communication circuitry may transmit and receive radio signals with at least one of a base station, an external terminal, and a server on a mobile communication network.

According to an embodiment, the communication module may communicate with an external device such as a server, a user device and other home appliances through an access point (AP). The access point (AP) may connect a local area network (LAN), to which a washing machine or a user device is connected, to a wide area network (WAN) to which a server is connected. The washing machine or the user device may be connected to the server through the wide area network (WAN). The controller may control various components of the washing machine (e.g., the drive motor, and the water supply valve). The controller may control various components of the washing machine to perform at least one operation including water supply, washing, rinsing, and/or spin-drying according to a user input. For example, the controller may control the drive motor to adjust the rotational speed of the drum or control the water supply valve of the water supply device to supply water to the tub.

The controller may include hardware such as a CPU or memory, and software such as a control program. For example, the controller may include at least one memory for storing an algorithm and program-type data for controlling the operation of components in the washing machine, and at least one processor configured to perform the above-mentioned operation by using the data stored in the at least one memory. The memory and the processor may each be implemented as separate chips. The processor may include one or more processor chips or may include one or more processing cores. The memory may include one or more memory chips or one or more memory blocks. Alternatively, the memory and the processor may be implemented as a single chip.

Hereinafter exemplary embodiments of the present disclosure will be described in detail with reference to the accompanying drawings.

Figure 2:
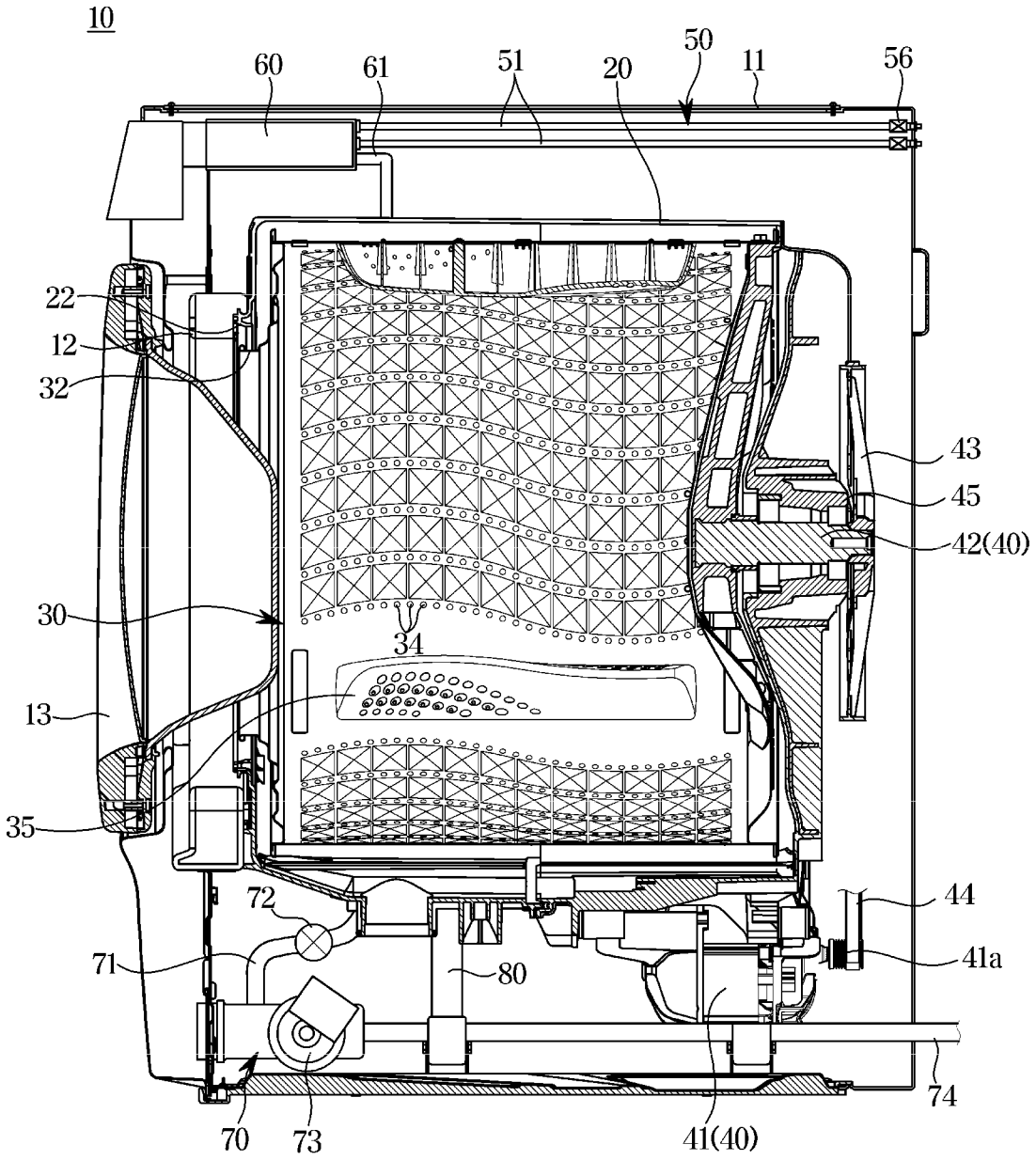
FIG. 2 illustrates a cross-section of a washing machine according to an embodiment of the disclosure.

FIG. 1 illustrates a clothes treating apparatus according to an embodiment of the disclosure. FIG. 2 illustrates a cross-section of a washing machine shown in FIG. 1.

As illustrated in FIGS. 1 and 2, a washing machine 10 of a clothes treating apparatus 1 may include a washing machine housing 11 provided to accommodate various components therein. The washing machine housing 11 may form an exterior of the washing machine 10. The washing machine housing 11 may have a box shape with one portion open.

The washing machine housing 11 may include a housing opening 12 formed to provide access to an interior of a drum 30. The housing opening 12 may be opened substantially forward.

The washing machine 10 may include a door 13 configured to open and close the housing opening 12 provided in the washing machine housing 11. The door 13 may be rotatably mounted on the washing machine housing 11 by a hinge 14. At least a portion of the door 13 may be transparent or translucent to allow an inside of the washing machine housing 11 to be seen.

The washing machine 10 may include a tub 20 disposed inside the washing machine housing 11 to store water. The tub 20 may be arranged inside the washing machine housing 11. The tub 20 may include a tub opening 22 provided to correspond to the housing opening 12. The tub opening 22 may be opened substantially forward. The tub 20 may be supported inside the washing machine housing 11. The tub 20 may have a substantially cylindrical shape with one side open.

The tub 20 may be elastically supported from the washing machine housing 11 by a damper 80. The damper 80 may connect the washing machine housing 11 and the tub 20. When vibration caused by the rotation of the drum 30 is transmitted to the tub 20 and/or the washing machine housing 11, the damper 80 may absorb vibration energy and dampen the vibration between the tub 20 and the washing machine housing 11.

The washing machine 10 may include the drum 30 provided to store laundry. The drum 30 may be rotatably provided inside the tub 20. The drum 30 may perform washing, rinsing, and/or spin-drying while rotating inside the tub 20. The drum 30 may include a through-hole 34 connecting an inner space of the drum 30 and an inner space of the tub 20. The drum 30 may have a substantially cylindrical shape with one side open. At least one lifter 35 may be installed on an inner peripheral surface of the drum 30 to allow laundry to rise and fall when the drum 30 rotates.

The drum 30 may include a drum opening 32 provided to correspond to the housing opening 12 and the tub opening 22. Laundry may be put into or taken out of the drum 30 through the housing opening 12, the tub opening 22, and the drum opening 32.

The washing machine 10 may include a washing machine driving device 40 configured to rotate the drum 30. The washing machine driving device 40 may include a drive motor 41 and a rotating shaft 42 for transmitting a driving force generated by the drive motor 41 to the drum 30. The rotating shaft 42 may penetrate the tub 20 and be connected to the drum 30.

The washing machine 10 may be classified into a direct drive type in which the rotating shaft 42 is directly connected to the drive motor 41 to rotate the drum 30, and an indirect drive type in which a pulley 43 is connected between the drive motor 41 and the rotating shaft 42 so as to drive the drum 30.

The washing machine 10 according to an embodiment may be provided as the indirect drive type, but is not limited thereto. Alternatively, the washing machine 10 may be provided as the direct drive type.

One end of the rotating shaft 42 may be connected to the drum 30, and the other end of the rotating shaft 42 may be connected to the pulley 43 to receive power from the drive motor 41. A motor pulley 41*a* may be formed on a rotation axis of the drive motor 41. A driving belt 44 may be provided between the motor pulley 41*a* and the pulley 43, and thus the rotating shaft 42 may be driven by the driving belt 44.

A bearing housing 45 may be installed in a portion of a rear side of the tub 20 so as to rotatably support the rotating shaft 42. The bearing housing 45 may be formed of aluminum alloy and may be inserted into a portion of the rear side of the tub 20 when the tub 20 is injection molded.

The washing machine driving device 40 may be configured to rotate the drum 30 forward or backward to perform washing, rinsing, and/or spin-drying, or drying operations.

The washing machine 10 may include a water supply device 50. The water supply device 50 may supply water to the tub 20. The water supply device 50 may be located above the tub 20. The water supply device 50 may include a water supply pipe 51 and a water supply valve 56 disposed in the water supply pipe 51. The water supply pipe 51 may be connected to an external water supply source. The water supply pipe 51 may extend from an external water supply source to a detergent supply device 60 and/or the tub 20. Water may be supplied to the tub 20 through the detergent supply device 60. Water may be supplied to the tub 20 without passing through the detergent supply device 60.

The water supply valve 56 may open or close the water supply pipe 51 in response to an electrical signal from a controller 90. The water supply valve 56 may allow or block the supply of water from an external water supply source to the tub 20. The water supply valve 56 may include a solenoid valve configured to open and close in response to an electrical signal.

The washing machine 10 may include the detergent supply device 60 configured to supply detergent to the tub 20. The detergent supply device 60 may be configured to supply detergent into the tub 20 during a water supply process. Water supplied through the water supply pipe 51 may be mixed with detergent by passing through the detergent supply device 60. Water mixed with detergent may be supplied into the inside of the tub 20. Detergent may include not only laundry detergent but also dryer rinse, deodorant, disinfectant, or air freshener. The detergent supply device 60 may be connected to the tub 20 through a connection pipe 61.

The washing machine 10 may include a drainage device 70. The drainage device 70 may be configured to discharge water stored in the tub 20 to the outside. The drainage device 70 may include a drain pump 73 for discharging the water in the tub 20 to the outside of the washing machine housing 11, a connection hose 71 provided to connect the tub 20 and the drain pump 73 to allow water inside the tub 20 to be introduced into the drain pump 73, and a drain hose 74 provided to guide water, which is pumped by the drain pump 73, to the outside of the washing machine housing 11. The drainage device 70 may include a drain valve 72 disposed on the connection hose 71 to open and close the connection hose 71.

The washing machine 10 may provide a user interface device 15 for interacting between a user and the washing machine 10.

The washing machine 10 may include at least one user interface device 15. The user interface device 15 may include at least one input interface 16 and at least one output interface 17.

The at least one input interface 16 may convert sensory information received from a user into an electrical signal.

The at least one input interface 16 may include a power button, an operation button, a course selection dial (or course selection button), and a washing/rinsing/spin-drying setting button. The at least one input interface 16 may include a tact switch, a push switch, a slide switch, a toggle switch, a micro switch, a touch switch, a touch pad, a touch screen, a jog dial, and/or a microphone.

The at least one output interface 17 may transmit various data related to the operation of the washing machine 10 to a user by generating sensory information.

For example, the at least one output interface 17 may convey information related to the washing course, operation time of the washing machine 10, and washing settings/rinsing settings/spin-drying settings to a user. Information related to the operation of the washing machine 10 may be output through a screen, indicator, voice, etc. The at least one output interface 17 may include a Liquid Crystal Display (LCD) panel, a Light Emitting Diode (LED) panel, a speaker, etc.

The clothes treating apparatus 1 may include a filter device 100 configured to be connected to the drainage device 70 of the washing machine 10. The filter device 100 may be disposed outside the washing machine 10. The filter device 100 may be configured to filter out foreign substances from water discharged from the washing machine 10. The filter device 100 may be configured to filter out foreign substances smaller than a size of foreign substances that are filtered out by the washing machine 10. For example, the filter device 100 may be configured to filter out foreign substances smaller than foreign substances that are filtered out by the drainage device 70 of the washing machine 10.

Figure 3:
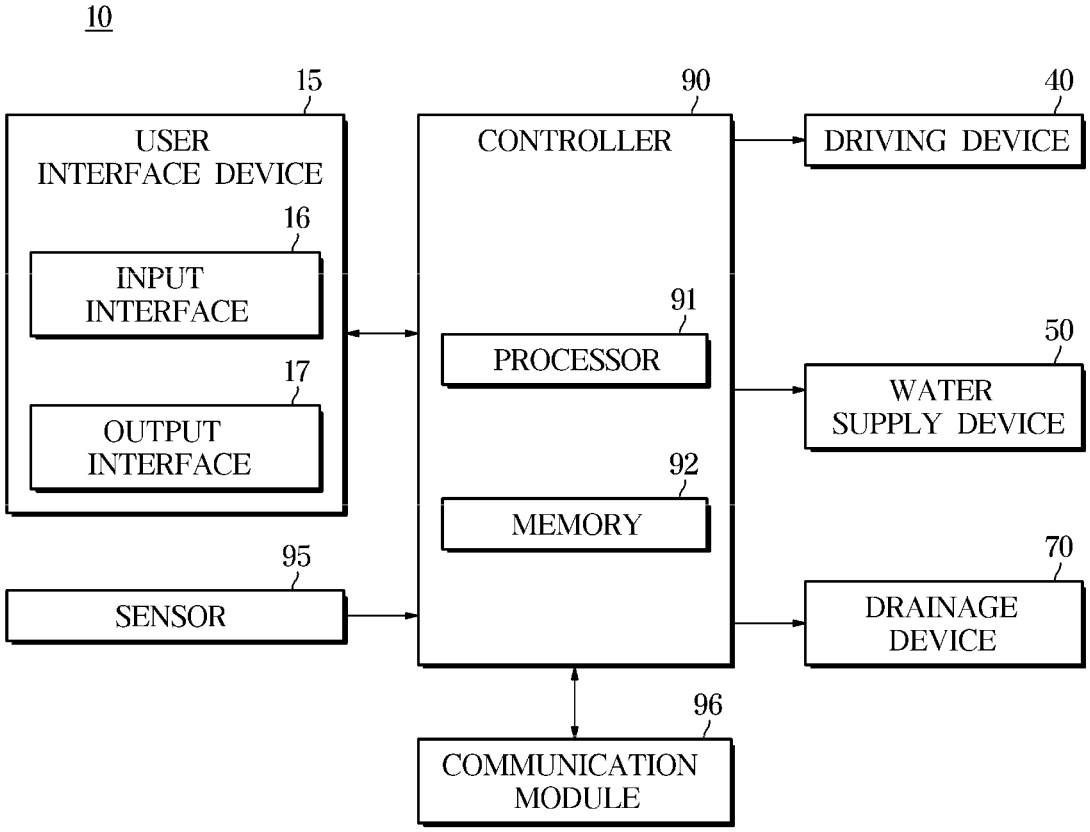
FIG. 3 is a control block diagram of the washing machine according to an embodiment of the disclosure.

FIG. 3 is a control block diagram of the washing machine according to an embodiment of the disclosure.

According to an embodiment, the washing machine 10 may include the user interface device 15, the driving device 40, the water supply device 50, the drainage device 70, a sensor 95, and a communication module 96 and the controller 90.

The user interface device 15 may provide a user interface for the washing machine 10 to interact with a user and the washing machine 10.

The user interface device 15 may include the at least one input interface 16 and the at least one output interface 17.

The at least one input interface 16 may convert sensory information received from a user into an electrical signal.

The at least one input interface 16 may include a power button, an operation button, a course selection dial (or course selection button), and a washing/rinsing/spin-drying setting button. The at least one input interface 16 may include a tact switch, a push switch, a slide switch, a toggle switch, a micro switch, a touch switch, a touch pad, a touch screen, a jog dial, and/or a microphone.

The at least one output interface 17 may transmit various data related to the operation of the washing machine 10 to a user by generating sensory information.

For example, the at least one output interface 17 may convey information related to the washing course, operation time of the washing machine 10, and washing settings/rinsing settings/spin-drying settings to a user. Information related to the operation of the washing machine 10 may be output through a screen, indicator, voice, etc. The at least one output interface 17 may include a Liquid Crystal Display (LCD) panel, a Light Emitting Diode (LED) panel, a speaker, etc.

The driving device 40 may include the drive motor 41 configured to supply a driving force to rotate the drum 30. The driving device 40 may operate based on a control signal from the controller 90.

The water supply device 50 may include the water supply valve 56 configured to open and close the water supply pipe 51 extending from an external water supply source to the detergent supply device 60 and/or the tub 20. The water supply valve 56 may be opened and closed based on a control signal from the controller 90.

The drainage device 70 may include the drain pump 73 for discharging water of the tub 20 to the outside of the housing 11 of the washing machine 10. The drain pump 73 may operate based on a control signal from the controller 90.

The sensor 95 may include at least one sensor configured to obtain information related to an operating state of the washing machine 10.

For example, the sensor 95 may include at least one of a water level sensor configured to detect a water level of the tub, a sensor configured to detect an operating state of the driving device 40, a water flow sensor configured to detect a flow rate flowing into the tub 20 through the water supply device 50, or a sensor configured to detect an operating state of the drainage device 70.

The sensor configured to detect an operating state of the driving device 40 may include a current sensor configured to measure a driving current applied to the drive motor 41, but is not limited thereto.

The sensor configured to detect an operating state of the drainage device 70 may include a current sensor configured to measure a driving current applied to the drainage pump 73, but is not limited thereto.

The washing machine 10 may include the communication module 96 for wired and/or wireless communication with an external device.

The communication module 96 may include at least one of a short-range wireless communication module and a long-range wireless communication module.

The communication module 96 may transmit data to or receive data from an external device (e.g., a server, a user device, a home appliance and/or the filter device 100). For example, the communication module 96 may establish communication with a server and/or a user device and/or a home appliance, and transmit and receive various types of data.

For the communication, the communication module 96 may establish a direct (e.g., wired) communication channel or a wireless communication channel with an external device, and support the performance of the communication through the established communication channel. According to an embodiment of the disclosure, the communication module 96 may include a wireless communication module (e.g., a cellular communication module, a short-range wireless communication module, or a global navigation satellite system (GNSS) communication module) or a wired communication module (e.g., a local area network (LAN) communication module, or a power line communication module). Among these communication modules, the corresponding communication module may communicate with an external device through a first network (e.g., a short-range wireless communication network such as Bluetooth, wireless fidelity (Wi-Fi) direct, or infrared data association (IrDA)) or a second network (e.g., a long-range wireless communication network such as a legacy cellular network, a 5G network, a next-generation communication network, the Internet, or a computer network (e.g., LAN or WAN). These various types of communication modules may be integrated as one component (e.g., a single chip) or implemented as a plurality of separate components (e.g., multiple chips).

The short-range wireless communication module may include a Bluetooth communication module, a Bluetooth Low Energy (BLE) communication module, a near field communication module, a WLAN (Wi-Fi) communication module, and a Zigbee communication module, an infrared data association (IrDA) communication module, a Wi-Fi Direct (WFD) communication module, an ultrawideband (UWB) communication module, an Ant$^+$ communication module, a microwave (uWave) communication module, etc., but is not limited thereto.

The long-range wireless communication module may include a communication module that performs various types of long-range wireless communication, and may include a mobile communication circuitry. The mobile communication circuitry transmits and receives radio signals with at least one of a base station, an external terminal, and a server on a mobile communication network.

According to an embodiment, the communication module may communicate with an external device such as a server, a user device and other home appliances through an access point (AP). The access point (AP) may connect a local area network (LAN), to which the washing machine 10 or a user device is connected, to a wide area network (WAN) to which a server is connected. The washing machine 10 or the user device may be connected to the server through the wide area network (WAN). The controller 90 may control various components of the washing machine 10 (e.g., the driving device 40 and the water supply device 50). The controller 90 may control various components of the washing machine 10 to perform at least one operation including water supply, washing, rinsing, and/or spin-drying according to a user input. For example, the controller 90 may control the drive motor 41 to adjust the rotational speed of the drum 30 or control the water supply valve 56 of the water supply device 50 to supply water to the tub 20.

The controller 90 may include hardware such as a CPU or memory, and software such as a control program. For example, the controller 90 may include at least one memory 92 for storing an algorithm and program-type data for controlling the operation of components in the washing machine 10, and at least one processor 91 configured to perform the above-mentioned operation by using the data stored in the at least one memory. The memory 92 and the processor 91 may each be implemented as separate chips. The processor 91 may include one or two or more processor chips or may include one or two or more processing cores. The memory 92 may include one or two or more memory chips or one or two or more memory blocks. Alternatively, the memory 92 and the processor 91 may be implemented as a single chip.

Figure 4:
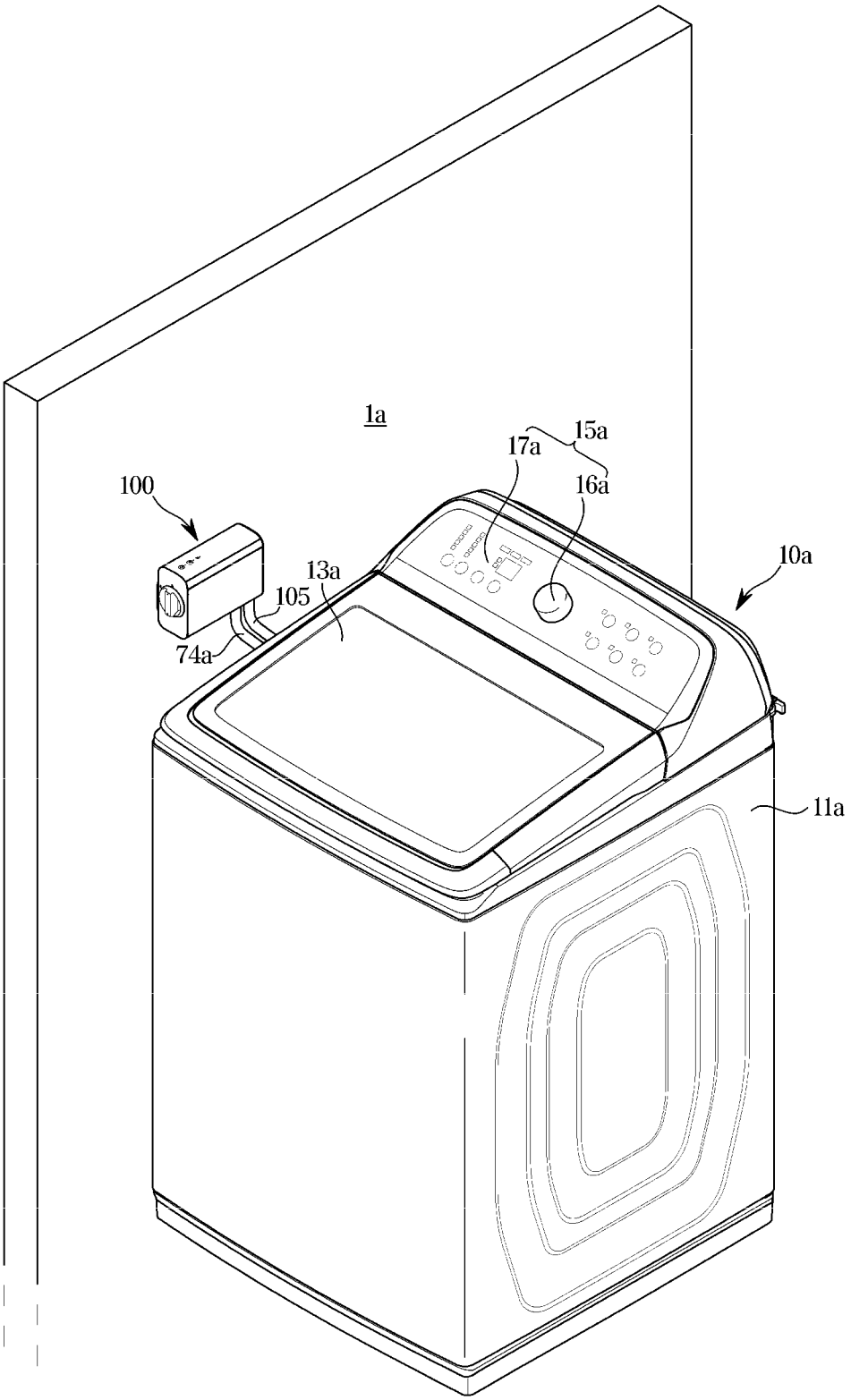
FIG. 4 illustrates a clothes treating apparatus according to an embodiment of the disclosure.
Figure 5:
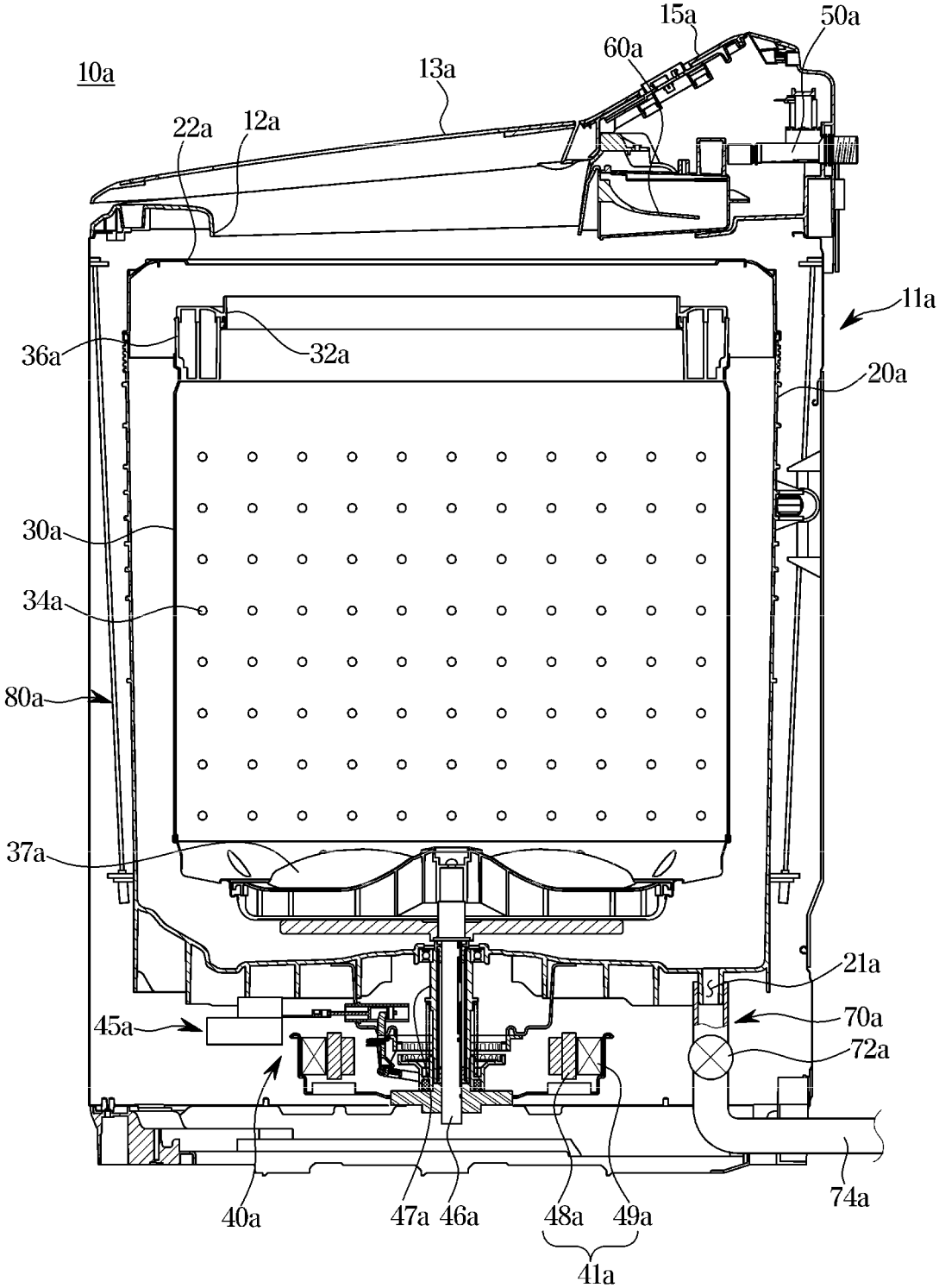
FIG. 5 illustrates a cross-section of a washing machine according to an embodiment of the disclosure.

FIG. 4 illustrates a clothes treating apparatus according to an embodiment of the disclosure. FIG. 5 illustrates a cross-section of a washing machine shown in FIG. 4.

As illustrated in FIGS. 4 and 5, a washing machine 10*a* of a clothes treating apparatus 1*a* may include a washing machine housing 11*a* provided to accommodate various components therein. The washing machine housing 11*a* may form an exterior of the washing machine 10*a*. The washing machine housing 11*a* may have a box shape with one portion open.

The washing machine housing 11*a* may include a housing opening 12*a* formed to provide access to an interior of a drum 30*a*. The housing opening 12*a* may be opened substantially upward.

The washing machine 10*a* may include a door 13*a* configured to open and close the housing opening 12*a* provided in the washing machine housing 11*a*. The door 13*a* may be rotatably mounted on the washing machine housing 11*a* by a hinge. At least a portion of the door 13*a* may be transparent or translucent to allow an inside of the washing machine housing 11*a* to be seen.

The washing machine 10*a* may include a tub 20*a* disposed inside the washing machine housing 11*a* to store water. The tub 20*a* may be arranged inside the washing machine housing 11*a*. The tub 20*a* may include a tub opening 22*a* provided to correspond to the housing opening 12*a*. The tub opening 22*a* may be opened substantially upward. The tub 20*a* may be supported inside the washing machine housing 11*a*. The tub 20*a* may have a substantially cylindrical shape with one side open.

The tub 20*a* may be elastically supported from the washing machine housing 11*a* by a damper 80*a*. The damper 80*a* may connect the washing machine housing 11*a* and the tub 20*a*. When vibration caused by the rotation of the drum 30*a* is transmitted to the tub 20*a* and/or the washing machine housing 11*a*, the damper 80*a* may absorb vibration energy and dampen the vibration between the tub 20*a* and the washing machine housing 11*a*.

The washing machine 10*a* may include the drum 30*a* provided to store laundry. The drum 30*a* may be rotatably provided inside the tub 20*a*. The drum 30*a* may perform washing, rinsing, and/or spin-drying while rotating inside the tub 20*a*. The drum 30*a* may include a through-hole 34*a* connecting an inner space of the drum 30*a* and an inner space of the tub 20*a*. The drum 30*a* may have a substantially cylindrical shape with one side open.

A balancing unit 36*a* may be installed above the drum 30*a* to resolve load imbalance caused by laundry. The balancing unit 36*a* may include a housing including an annular channel, and a ball or fluid mass configured to move inside the channel. Accordingly, the load imbalance of the drum 30*a* may be resolved as the ball or fluid moves according to the rotation of the drum 30*a*.

A pulsator 37*a* may be configured to rotate in a lower portion of the drum 30*a* so as to generate a wash water stream. Laundry may be washed by the wash water stream generated by the pulsator 37*a*.

The drum 30*a* may include a drum opening 32*a* provided to correspond to the housing opening 12*a* and the tub opening 22*a*. Laundry may be put into or taken out from the drum 30*a* through the housing opening 12*a*, the tub opening 22*a*, and the drum opening 32*a*.

The washing machine 10*a* may include a washing machine driving device 40*a* configured to rotate the drum 30*a* and the pulsator 37*a*. The washing machine driving device 40*a* may include a drive motor 41*a* and a shaft system for transmitting a driving force generated by the drive motor 41*a* to the drum 30*a* and the pulsator 37*a*.

The drive motor 41*a* may include a stator 48*a* that is fixed and a rotor 49*a* configured to rotate by electromagnetically interacting with the stator 48*a*.

The shaft system may include a spin-drying shaft 47*a* configured to transmit the driving force of the drive motor 41*a* to the drum 30*a*, a washing shaft 46*a* configured to transmit the driving force of the drive motor 41*a* to the pulsator 37*a*, and a clutch device 45*a* configured to connect or disconnect between the drive motor 41*a* and the spin-drying shaft 47*a*.

The spin-drying shaft 47*a* may be formed to have a hollow, and the washing shaft 46*a* may be disposed in the hollow of the spin-drying shaft 47*a*. The washing shaft 46*a* may be maintained in a state of being connected to the rotor 49*a* of the drive motor 41*a*. However, the spin-drying shaft 47*a* may be connected to or disconnected from the rotor 49*a* of the drive motor 41*a* by the clutch device 45*a*.

When the clutch device 45*a* disconnects between the spin-drying shaft 47*a* and the drive motor 41*a*, power may be transmitted only to the washing shaft 46*a*, and thus only the pulsator 37*a* may rotate. When the clutch device 45*a* connects the spin-drying shaft 47*a* and the drive motor 41*a*, power may be transmitted to both the spin-drying shaft 47*a* and the washing shaft 46*a*, and thus the drum 30*a* and the pulsator 37*a* may rotate simultaneously.

When only the pulsator 37*a* rotates, a wash water stream may be generated by the rotation of the pulsator 37*a*, and laundry may be washed while the laundry is rotated and rubbed against the drum 30*a* by the generated wash water stream. When the pulsator 37*a* and the drum 30*a* rotate simultaneously, the laundry inside the drum 30*a* may be rotated and moisture of the laundry may be removed by centrifugal force. Accordingly, the laundry may be spin-dried.

The washing machine 10*a* may include a water supply device 50*a*. The water supply device 50*a* may supply water to the tub 20*a*. The water supply device 50*a* may be disposed above the tub 20*a*. The water supply device 50*a* may include a water supply pipe and a water supply valve provided in the water supply pipe. The water supply pipe may be connected to an external water supply source. The water supply pipe may extend from an external water supply source to a detergent supply device 60*a* and/or the tub 20*a*. Water may be supplied to the tub 20*a* through the detergent supply device 60*a*. Water may be supplied to the tub 20*a* without passing through the detergent supply device 60*a*.

The water supply valve may open or close the water supply pipe in response to an electrical signal from a controller. The water supply valve may allow or block the supply of water from an external water supply source to the tub 20*a*. The water supply valve may include a solenoid valve configured to open and close in response to an electrical signal.

The washing machine 10*a* may include the detergent supply device 60*a* configured to supply detergent to the tub 20*a*. The detergent supply device 60*a* may be configured to supply detergent into the tub 20*a* during a water supply process. Water supplied through the water supply pipe may be mixed with detergent by passing through the detergent supply device 60*a*. Water mixed with detergent may be supplied into the interior of the tub 20*a*. Detergent may include not only laundry detergent but also dryer rinse, deodorant, disinfectant, or air freshener.

The washing machine 10*a* may include a drainage device 70*a*. The drainage device 70*a* may be configured to discharge water stored in the tub 20*a* to the outside. A drain port 21*a* for draining water stored in the tub 20 to the outside of the tub 20*a* may be formed in the lower portion of the tub 20*a*. A drain hose 74*a* may be connected to the drain port 21*a* and a drain valve 72*a* configured to open and close the drain hose 74*a* may be provided in the drain hose 74*a*.

The washing machine 10*a* may provide a user interface device 15*a* for interacting between a user and the washing machine 10*a*.

The washing machine 10*a* may include at least one user interface device 15*a*. The user interface device 15*a* may include at least one input interface 16*a* and at least one output interface 17*a*.

The at least one input interface 16*a* may convert sensory information received from a user into an electrical signal.

The at least one input interface 16*a* may include a power button, an operation button, a course selection dial (or course selection button), and a washing/rinsing/spin-drying setting button. The at least one input interface 16*a* may include a tact switch, a push switch, a slide switch, a toggle switch, a micro switch, a touch switch, a touch pad, a touch screen, a jog dial, and/or a microphone.

The at least one output interface 17*a* may transmit various data related to the operation of the washing machine 10*a* to a user by generating sensory information.

For example, the at least one output interface 17*a* may convey information related to the washing course, operation time of the washing machine 10*a*, and washing settings/rinsing settings/spin-drying settings to a user. Information related to the operation of the washing machine 10*a* may be output through a screen, indicator, voice, etc. The at least one output interface 17*a* may include a Liquid Crystal Display (LCD) panel, a Light Emitting Diode (LED) panel, a speaker, etc.

The clothes treating apparatus 1*a* may include a filter device 100 that is the same as the filter device 100 described in FIGS. 1 and 2. For example, the filter device 100 according to an embodiment may be connected to a front-loading washing machine or a top-loading washing machine. The filter device 100 may be configured to be connected to the drainage device 70*a* of the washing machine 10*a*. The filter device 100 may be disposed outside the washing machine 10*a*. The filter device 100 may be configured to filter out foreign substances from water discharged from the washing machine 10*a*. The filter device 100 may be configured to filter out foreign substances smaller than a size of foreign substances that are filtered out by the washing machine 10*a*. For example, the filter device 100 may be configured to filter out foreign substances smaller than foreign substances that are filtered out by the drainage device 70*a* of the washing machine 10*a*.

A control configuration the same as that of the washing machine 10 shown in FIG. 3 may be applied to the washing machine 10*a* of the clothes treating apparatus 1*a* shown in FIGS. 4 and 5.

Figure 6:
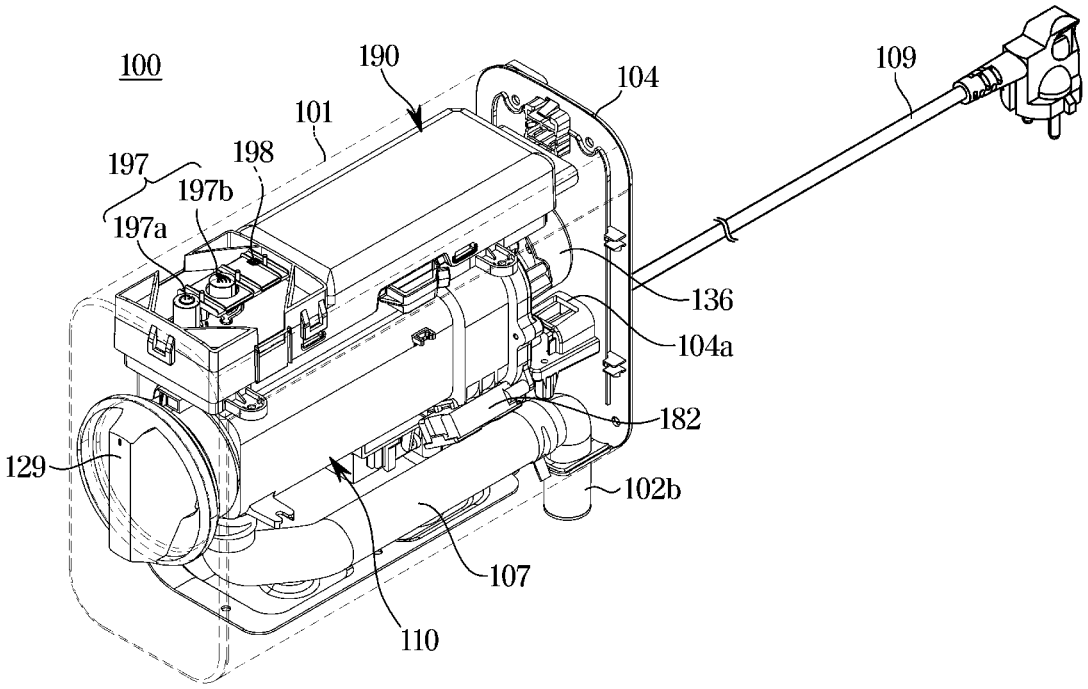
FIG. 6 illustrates an interior of a filter device according to an embodiment of the disclosure.
Figure 7:
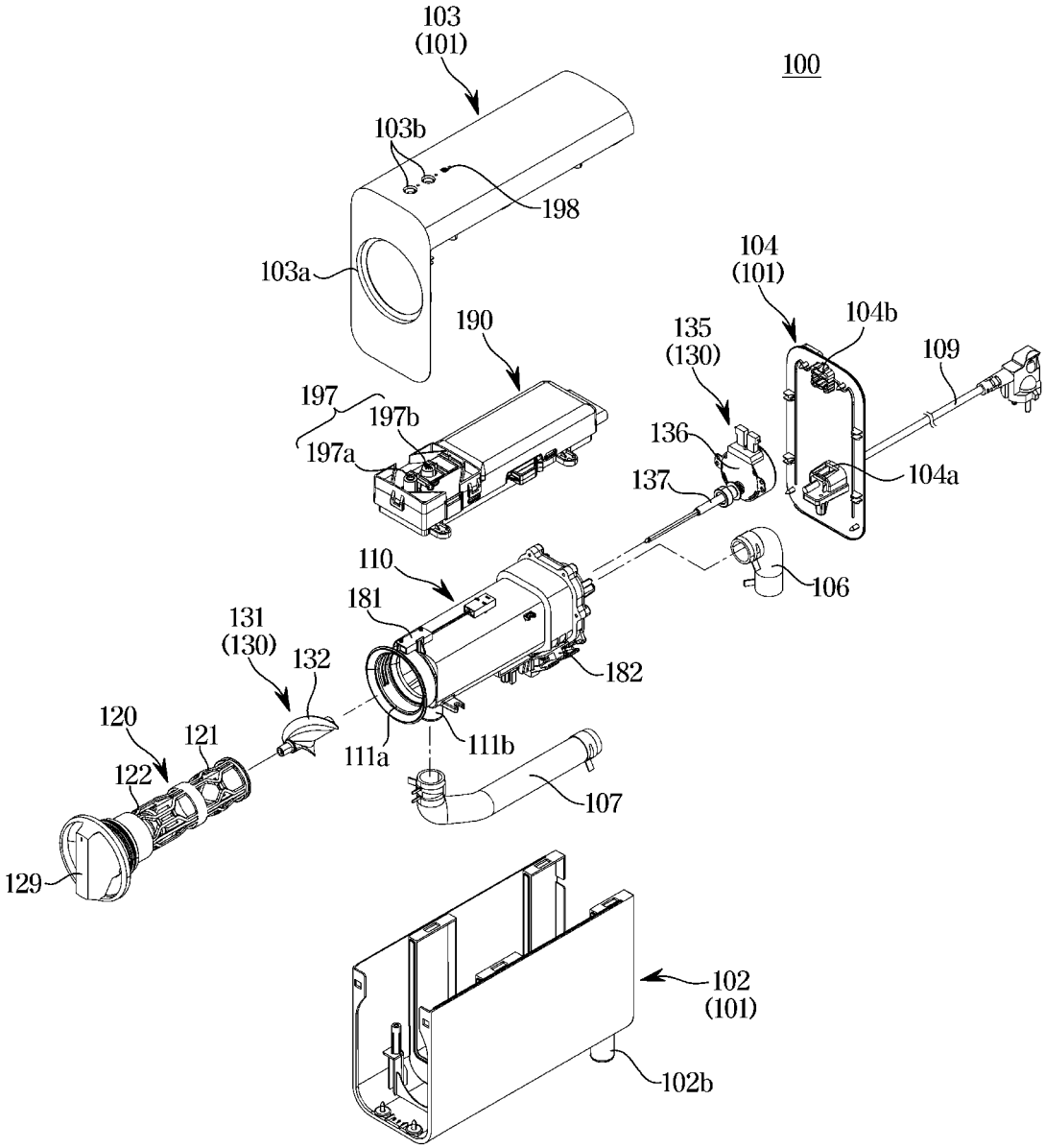
FIG. 7 is an exploded view of the filter device according to an embodiment of the disclosure.
Figure 8:
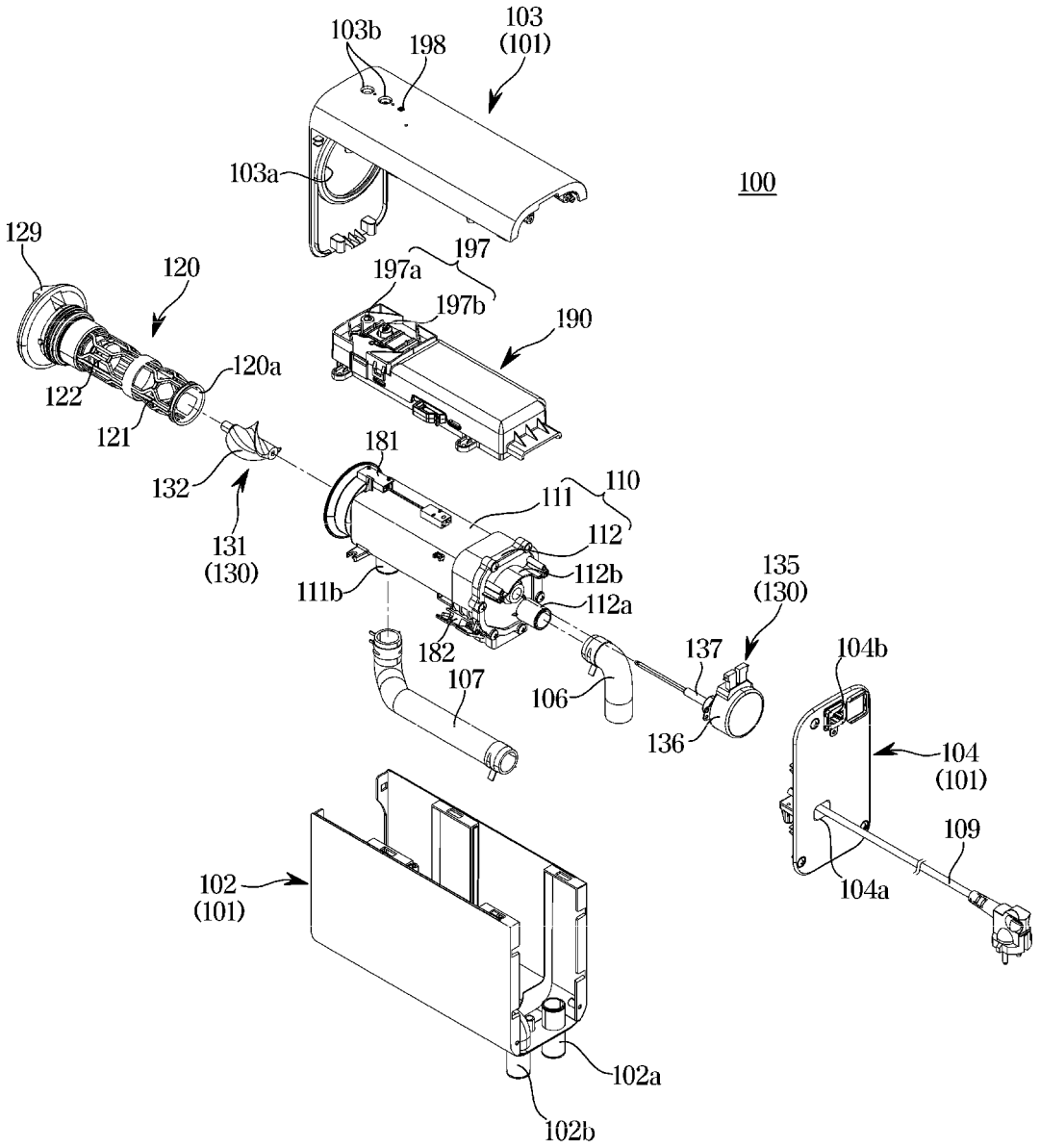
FIG. 8 illustrates the filter device according to an embodiment of the disclosure when viewed from a direction different from FIG. 7.
Figure 9:
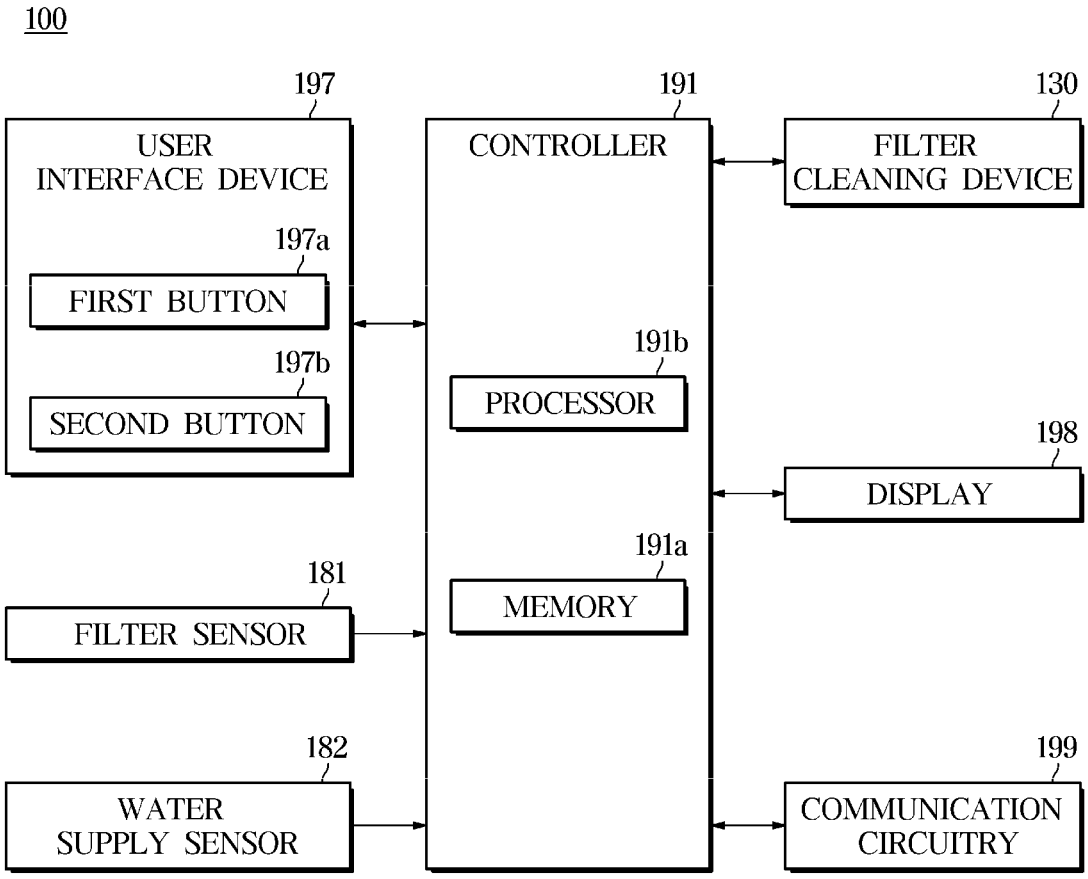
FIG. 9 is a control block diagram of the filter device according to an embodiment of the disclosure.
Figure 10:
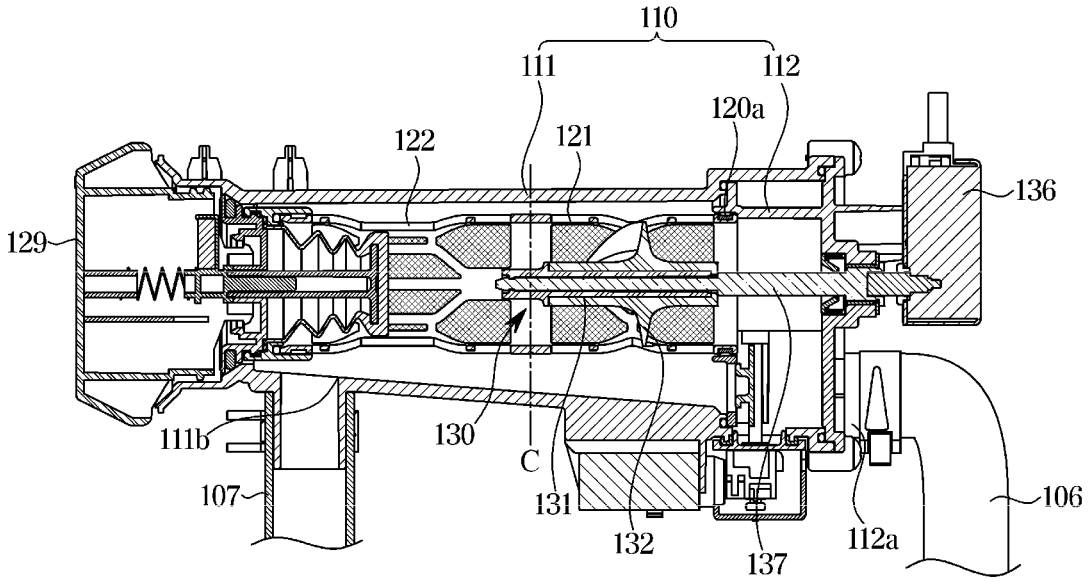
FIG. 10 illustrates a cross-section of some components of the filter device according to an embodiment of the disclosure.

FIG. 6 illustrates an interior of the filter device shown in FIGS. 1 and 4 according to an embodiment of the disclosure. FIG. 7 is an exploded view of the filter device shown in FIG. 6. FIG. 8 illustrates the filter device shown in FIG. 7 when viewed from a direction different from FIG. 7. FIG. 9 is a control block diagram of the filter device according to an embodiment of the disclosure. FIG. 10 illustrates a cross-section of some components of the filter device shown in FIG. 6.

Referring to FIGS. 6 to 8, the filter device 100 according to an embodiment of the disclosure may include a filter housing 101 provided to accommodate various components. The filter housing 101 may include a housing body 102, a housing cover 103, and a housing bracket 104. For example, the housing body 102, the housing cover 103, and the housing bracket 104 may each be provided in a separate configuration. For example, the housing body 102 may be formed integrally with the housing cover 103. For example, the housing body 102 may be formed integrally with the housing bracket 104. For example, the housing cover 103 may be formed integrally with the housing bracket 104. For example, the housing body 102 may be formed integrally with the housing cover 103 and the housing bracket 104.

The housing body 102 may form a space for accommodating various components. The housing body 102 may have a substantially U-shape in cross-section that is perpendicular to a direction in which a filter 120 accommodated therein extends. The housing body 102 may have a box shape with open front, rear, and upper surfaces. The housing body 102 may be removably coupled to the housing cover 103 and/or the housing bracket 104.

The housing body 102 may include a housing inlet 102*a* configured to allow water to flow into the filter device 100, and a housing outlet 102*b* configured to discharge water in the filter device 100 to the outside of the filter device 100. The housing inlet 102*a* and/or the housing outlet 102*b* may be disposed in a lower portion of the housing body 102.

The housing inlet 102*a* may be connected to the drain hose 74 or 74*a* of the washing machine 10 or 10*a*. The housing outlet 102*b* may be connected to a drain line 105.

The housing cover 103 may be provided to cover the open front and upper surfaces of the housing body 102. The housing cover 103 may be removably coupled to the housing body 102 and/or the housing bracket 104. The housing cover 103 may include a cover opening 103*a* provided to allow the filter 120 to pass therethrough. The housing cover 103 may include an installation portion 103*b* on which a user interface device 197 is installed. At least a portion of the user interface device 197 may be exposed to the outside of the filter device 100 through the installation portion 103*b*.

The housing bracket 104 may be provided to cover the open rear surface of the housing body 102. The housing bracket 104 may be removably coupled to the housing body 102 and/or the housing cover 103. The housing bracket 104 may include a cable opening 104*a* through which a power cable 109 passes. The housing bracket 104 may include a connector mounting portion 104*b* to which a connector for communication with an external device such as the washing machine 10 is connected.

The filter device 100 may include a filter case 110 disposed inside the filter housing 101. The filter case 110 may form a flow path through which water flowing into the filter device 100 passes. The filter case 110 may be provided to accommodate the filter 120. The filter case 110 may include a case body 111 and a case cover 112.

The case body 111 may extend along the direction in which the filter 120 accommodated therein extends. The case body 111 may include a case opening 111*a* through which the filter 120 passes. The case opening 111*a* may be provided to correspond to the cover opening 103*a*. The case opening 111*a* may be located closer to a case outlet 111*b* than a case inlet 112*a*, and may be provided to allow the filter 120 to pass therethrough.

The case body 111 may include the case outlet 111*b* configured to discharge water, which flows into the filter case 110, from the filter case 110. The case outlet 111*b* may be located in a lower part of the case body 111. The case outlet 111*b* may be located adjacent to the case opening 111*a*. The case outlet 111*b* may be located close to the other end of the filter 120, which is opposite to one end in which a filter opening 120*a* is located. The case outlet 111*b* may be located closer to a second filter 122 than a first filter 121 of the filter 120.

The case outlet 111*b* may be connected to the housing outlet 102*b*. The filter device 100 may include a discharge guide 107 for connecting the case outlet 111*b* and the housing outlet 102*b*.

The case cover 112 may be removably coupled to the other end of the case body 111 opposite to one end in which the case opening 111*a* is located. For example, the case cover 112 may be formed integrally with the case body 111.

The case cover 112 may include the case inlet 112*a* through which water flows into the filter case 110. The case inlet 112*a* may be connected to the housing inlet 102*a*. The filter device 100 may include an inlet guide 106 for connecting the case inlet 112*a* and the housing inlet 102*a*.

The case cover 112 may include a motor mounting portion 112*b* for mounting a filter cleaning device 130. The motor mounting portion 112*b* may be located above the case inlet 112*a*. A cleaning motor 136 of the filter cleaning device 130 may be mounted on the motor mounting portion 112*b*.

The filter device 100 may include the filter 120 provided to be removably coupled to the filter case 110. The filter 120 may be configured to filter out fine-sized foreign substances. The filter 120 may be configured to filter out microplastics of approximately 5 mm or less in size. The filter 120 may include a mesh filter. The filter 120 may extend substantially between the case inlet 112*a* and the case outlet 111*b*.

The filter 120 may include the filter opening 120*a* provided to open toward the case inlet 112*a* when the filter 120 is mounted on the filter case 110. Water flowing into the filter case 110 through the case inlet 112*a* may move into the inside of the filter 120 through the filter opening 120*a*.

The filter 120 may include the first filter 121 and the second filter 122. The first filter 121 may be located closer to the case inlet 112*a* than the second filter 122. Foreign substances contained in the water flowing into the filter case 110 may be filtered out by the first filter 121 or the foreign substances may pass through the first filter 121 without being filtered out by the first filter 121, and then be filtered out by the second filter 122. The first filter 121 and the second filter 122 may be sequentially arranged along the direction in which the filter 120 extends. Foreign substances transferred from the first filter 121 by the filter cleaning device 130 may be collected in the second filter 122.

The filter device 100 may include a handle 129 in which at least a portion thereof is exposed to the outside of the filter housing 101 when the filter 120 is mounted on the filter case 110. For example, the handle 129 may be removably coupled to the filter 120. Because the handle 129 is removably coupled to the filter 120, the filter 120 may be easily maintained and/or repaired. The handle 129 may be rotatably coupled to the cover opening 103*a* and/or the case opening 111*a*.

The filter device 100 may include the filter cleaning device 130 for cleaning the filter 120. The filter cleaning device 130 may be mounted on the filter case 110. The filter cleaning device 130 may include a cleaning member 131 for cleaning a surface of the filter 120 through which foreign substances are filtered out, and a cleaning drive device 135 for driving the cleaning member 131.

The cleaning member 131 may be located inside the filter 120. The cleaning member 131 may be provided to correspond to the first filter 121 of the filter 120. The cleaning member 131 may include a blade 132 extending spirally. The blade 132 may extend in a radial direction from a rotation axis of the cleaning member 131. The cleaning member 131 may be provided to be in contact with the surface of the filter 120 through which foreign substances are filtered out. The cleaning member 131 may be provided to be in contact with an inner surface of the filter 120. For example, the cleaning member 131 may include a plurality of brushes.

While the cleaning member 131 is driven by the cleaning drive device 135, the cleaning member 131 may transfer foreign substances, which are filtered out by a portion of the filter 120 close to the case inlet 112*a*, to a portion that is close to the case outlet 111*b* of the filter 120. The cleaning member 131 may be configured to transfer foreign substances, which are filtered out by the first filter 121, to the second filter 122. For example, the cleaning member 131 may be configured to rotate inside the filter 120. The cleaning member 131 may include a flexible material. While the cleaning member 131 rotates in a state of being in contact with the filter 120, the cleaning member 131 may clean foreign substances filtered out by the filter 120. While the cleaning member 131 is driven in contact with the filter 120, the cleaning member 131 may scrape and remove foreign substances attached to a filtering surface of the filter 120. For example, the cleaning member 131 may be configured to slide inside the filter 120.

Because the cleaning member 131 is provided to transfer foreign substances filtered out by the first filter 121 to the second filter 122, and the water flowing into the filter case 110 flows from the first filter 121 to the second filter 122, foreign substances filtered out by the first filter 121 may be efficiently collected in the second filter 122. In consideration with the flow of water passing through the filter 120, the cleaning member 131 may be disposed behind a reference line C shown in FIG. 10, and the case outlet 111*b* may be disposed in front of the reference line C shown in FIG. 10.

The cleaning drive device 135 may include the cleaning motor 136 and a motor shaft 137. The cleaning motor 136 may be configured to generate power to drive the cleaning member 131. The motor shaft 137 may be connected to the cleaning member 131. The cleaning motor 136 may be mounted on the filter case 110. The cleaning motor 136 may be located closer to the case inlet 112*a* than the case outlet 111*b*.

The filter device 100 may include a circuitry 190 located inside the filter housing 101. The circuitry 190 may be located at the upper end of the inside of the filter housing 101. The circuitry 190 may be located on one side of the filter case 110. For example, the circuitry 190 may be located on the upper side of the filter case 110. For example, the circuitry 190 may be disposed above the filter 120.

The circuitry 190 may be provided with a controller 191 for controlling the filter device 100 and a communication circuitry 199 for communicating with the washing machine 10 or 10*a*.

The filter device 100 may include the user interface device 197 located above the circuitry 190. At least a portion of the user interface device 197 may be exposed to the outside of the filter device 100 through the installation portion 103*b* of the filter housing 101. The user interface device 197 may be located on the upper surface of the filter device 100. The user interface device 197 may include a first button 197*a* and a second button 197*b*. The first button 197*a* may include one of a power button and a WiFi connection button. The second button 197*b* may include one of the power button and the WiFi connection button, which is different from the first button 197*a*.

The filter device 100 may include a display 198 provided to display visualized information related to the filter device 100. The display 198 may be located on the upper surface of the filter device 100. For example, the display 198 may be provided as a component of the user interface device 197.

The filter device 100 may include a filter sensor 181 configured to obtain information about the state of the filter 120. The filter sensor 181 may be mounted on the filter case 110. The filter sensor 181 may be located outside the filter case 110. The filter sensor 181 may be positioned to correspond to the second filter 122 of the filter 120 mounted on the filter case 110. For example, the filter sensor 181 may include a magnetic sensor. Alternatively, the filter sensor 181 may include an optical sensor.

The filter device 100 may include a water supply sensor 182 configured to detect that water is supplied to the filter device 100. The water supply sensor 182 may be mounted on the lower part of the filter case 110. The water supply sensor 182 may be located close to the case inlet 112*a* of the filter case 110.

FIG. 9 is a control block diagram of the filter device according to an embodiment of the disclosure.

The filter device 100 according to an embodiment may include the user interface device 197 for interaction with a user, the filter sensor 181, the water supply sensor 182, the filter cleaning device 130, the display 198, the communication circuitry 199, and the controller 191 configured to control various configurations of the filter device 100.

The controller 191 may include at least one memory 191*a* and at least one processor 191*b* to perform the operations described above and operations described later.

According to an embodiment, the controller 191 may include the at least one memory 191*a* configured to store an algorithm and/or program-type data for controlling the operation of components in the filter device 100, and the at least one processor 191*b* configured to perform the above-mentioned operation by using the data stored in the at least one memory 191*a*. The memory 191*a* and the processor 191*b* may each be implemented as separate chips. The processor 191*b* may include one or two or more processor chips or may include one or two or more processing cores. The memory 191*a* may include one or two or more memory chips or one or two or more memory blocks. Alternatively, the memory 191*a* and the processor 191*b* may be implemented as a single chip.

The controller 191 may process user input received through the user interface device 197, and control various components of the filter device 100 (e.g., the filter cleaning device 130 and the display 198) based on the processed user input.

The user interface device 197 may include the first button 197*a* and the second button 197*b*, and may operate based on a control signal from the controller 191.

The filter sensor 181 may be mounted on the filter case 110. The filter sensor 181 may detect an amount of foreign substances collected in the filter 120.

For example, the filter sensor 181 may include an optical sensor (e.g., an infrared sensor) configured to detect the amount of foreign substances collected in the filter 120. However, the type of filter sensor 181 is not limited thereto, and any configuration configured to detect the amount of foreign substances collected in the filter 120 may be used as the filter sensor 181.

The water supply sensor 182 may be mounted on the filter case 110. The water supply sensor 182 may detect that water flows into the filter case 110.

For example, the water supply sensor 182 may include a capacitance sensor configured to detect that water flows into the filter case 110. However, the type of water supply sensor 182 is not limited thereto, and any configuration configured to detect that water flows into the filter case 110 may be used as the water supply sensor 182.

The controller 191 may process sensor data received through the filter sensor 181 and/or the water supply sensor 182, and control various components of the filter device 100 (e.g., the filter cleaning device 130) based on the processed sensor data.

The filter cleaning device 130 may include the cleaning member 131 slidably and rotatably inserted into the inner surface of the filter 120, and the cleaning motor 136 for rotating the cleaning member 131.

The controller 191 may control the filter cleaning device 130.

According to an embodiment, the controller 191 may control a driving circuit configured to apply a driving current to the cleaning motor 136. The driving circuit may supply a driving current to the cleaning motor 136 in response to a driving signal from the controller 191. The driving circuit may include a rectifier circuit configured to rectify AC power from an external power source, a DC link circuit configured to remove a ripple of the rectified power and output DC power, an inverter circuit configured to convert the DC power into sinusoidal drive power and output the driving current to the cleaning motor 136, a current sensor configured to measure the driving current supplied to the cleaning motor 136, and a gate driver configured to turn on/off a switching device included in the inverter circuit based on a driving signal of the controller 191.

The driving circuit connected to the cleaning motor 136 may include components for driving a DC motor.

The display 198 may display visualized information related to the filter device 100. For example, the display 198 may be provided as a configuration separated from the user interface device 197. For example, the display 198 may be provided as a component of the user interface device 197.

The communication circuitry 199 may transmit data to an external device or receive data from the external device based on a control signal of the controller 191. For example, the communication circuitry 199 may communicate with a server and/or a user device and/or a home appliance including the washing machine 10 or 10*a*, and transmit and receive various types of data.

For the communication, the communication circuitry 199 may establish a direct (e.g., wired) communication channel or a wireless communication channel with external devices (e.g., a server and/or a user device and/or a home appliance), and support the performance of the communication through the established communication channel. According to an embodiment, the communication circuitry 199 may include a wireless communication module (e.g., a cellular communication module, a short-range wireless communication module, or a global navigation satellite system (GNSS) communication module) or a wired communication module (e.g., a local area network (LAN) communication module, or a power line communication module). Among these communication modules, the corresponding communication module may communicate with an external device through a first network (e.g., a short-range wireless communication network such as Bluetooth, wireless fidelity (Wi-Fi) direct, or infrared data association (IrDA)) or a second network (e.g., a long-range wireless communication network such as a legacy cellular network, a 5G network, a next-generation communication network, the Internet, or a computer network (e.g., LAN or WAN). These various types of communication modules may be integrated as one component (e.g., a single chip) or implemented as a plurality of separate components (e.g., multiple chips).

According to various embodiments, the communication circuitry 199 may establish communication with a user terminal device through a server.

According to various embodiments, the communication circuitry 199 may include a Wi-Fi module and perform communication with an external server and/or a user terminal device based on establishing communication with an access point (AP) within the home.

Figure 11:
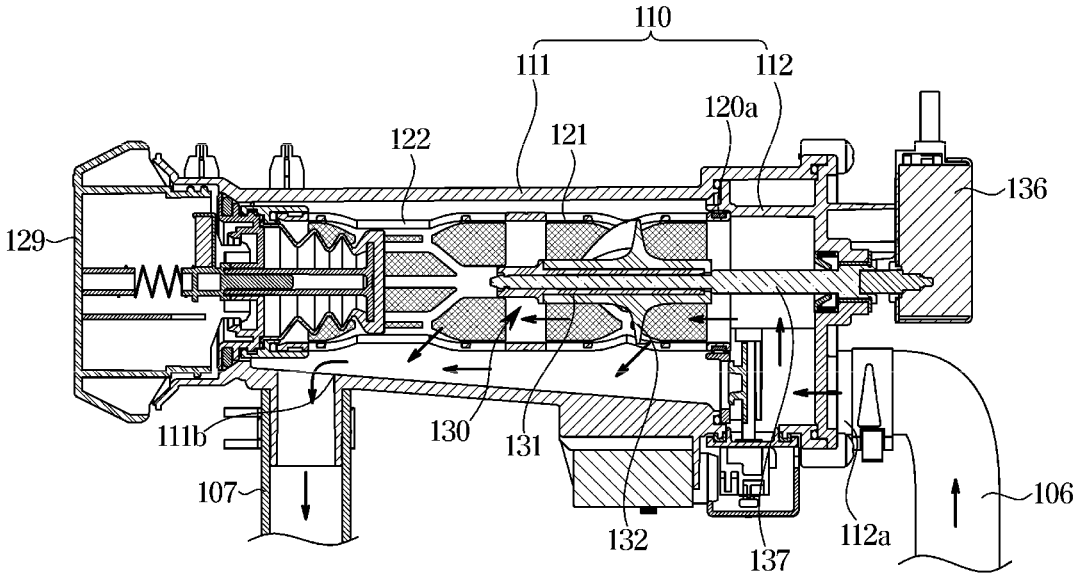
FIG. 11 illustrates a flow of water that flows into a filter case according to an embodiment of the disclosure and passes through a filter and then is discharged.
Figure 12:
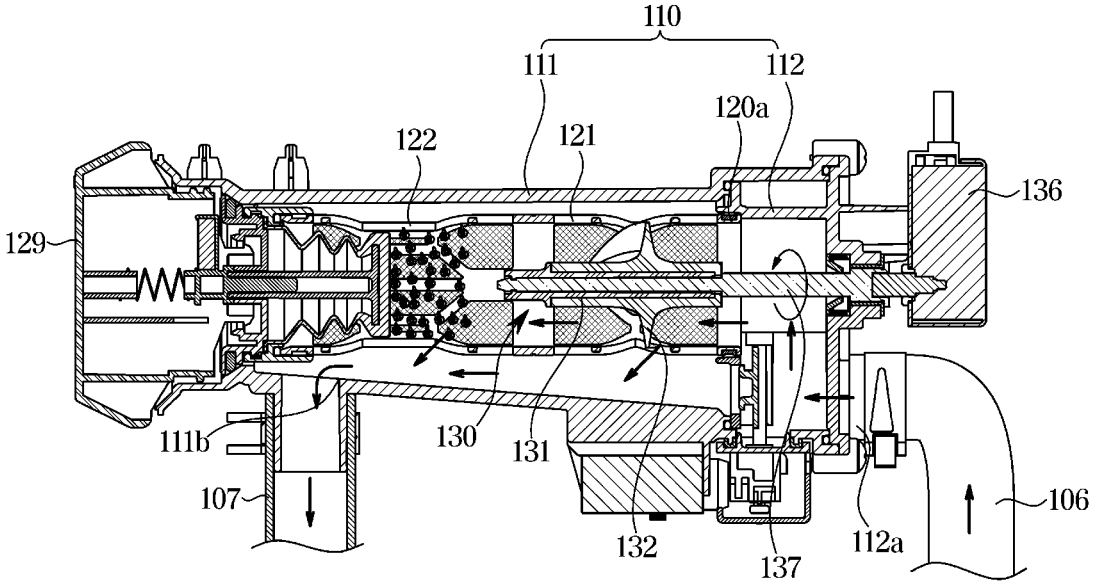
FIG. 12 illustrates a state in which foreign substances inside the filter are collected by a filter cleaning device according to an embodiment of the disclosure.

FIG. 11 illustrates a flow of water that flows into a filter case shown in FIG. 10 and passes through a filter and then is discharged. FIG. 12 illustrates a state in which foreign substances inside the filter are collected by a filter cleaning device shown in FIG. 10.

Referring to FIG. 11, water flowing into the filter device 100 through the housing inlet 102*a* may be guided to the filter case 110 by the inlet guide 106. Water flowing into the inside of the filter case 110 through the case inlet 112*a* may flow into the inside of the filter 120 through the filter opening 120*a*. Water flowing into the filter case 110 may flow into the inside of the filter 120. Water flowing into the filter 120 may pass through the filter 120 and foreign substances contained therein may be filtered out. Water passing through the filter 120 may be discharged to the outside of the filter case 110 through the case outlet 111*b*. Water discharged through the case outlet 111*b* may sequentially pass through the discharge guide 107 and the housing outlet 102*b* and be discharged from the filter device 100. Water discharged from the filter device 100 may be guided through the drain line 105.

Referring to FIG. 12, during water flowing into the filter case 110 passes through the filter 120 and foreign substances are filtered out, the foreign substances may accumulate on the inner surface (filtering surface) of the filter 120. The filter cleaning device 130 may transfer the foreign substances accumulated on the inner surface of the filter 120 to one end of the filter 120. The filter cleaning device 130 may remove the foreign substances, which are filtered out through the inner surface of the filter 120, from the inner surface of the filter 120. The filter cleaning device 130 may clean the inner surface of the filter 120 through which the foreign substances are filtered out. The filter cleaning device 130 may clean the filter 120 as the blade 132 rotates with respect to the filter 120 in a state in which the blade 132 is in contact with the inner surface of the filter 120.

Figure 13:
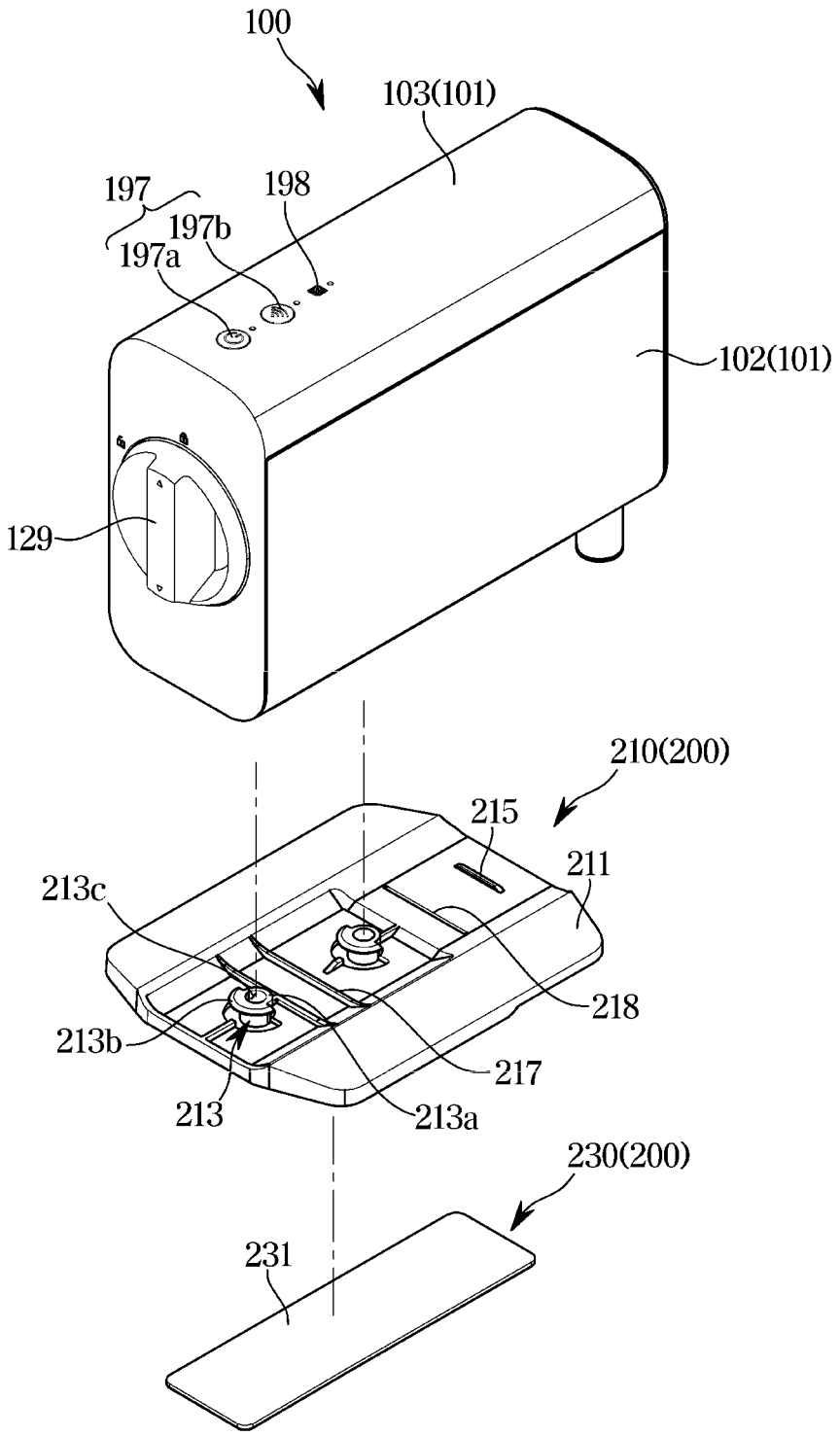
FIG. 13 illustrates a state in which the filter device of the clothes treating apparatus according to an embodiment of the disclosure is mounted on an upper surface of the washing machine through an installation device.
Figure 14:
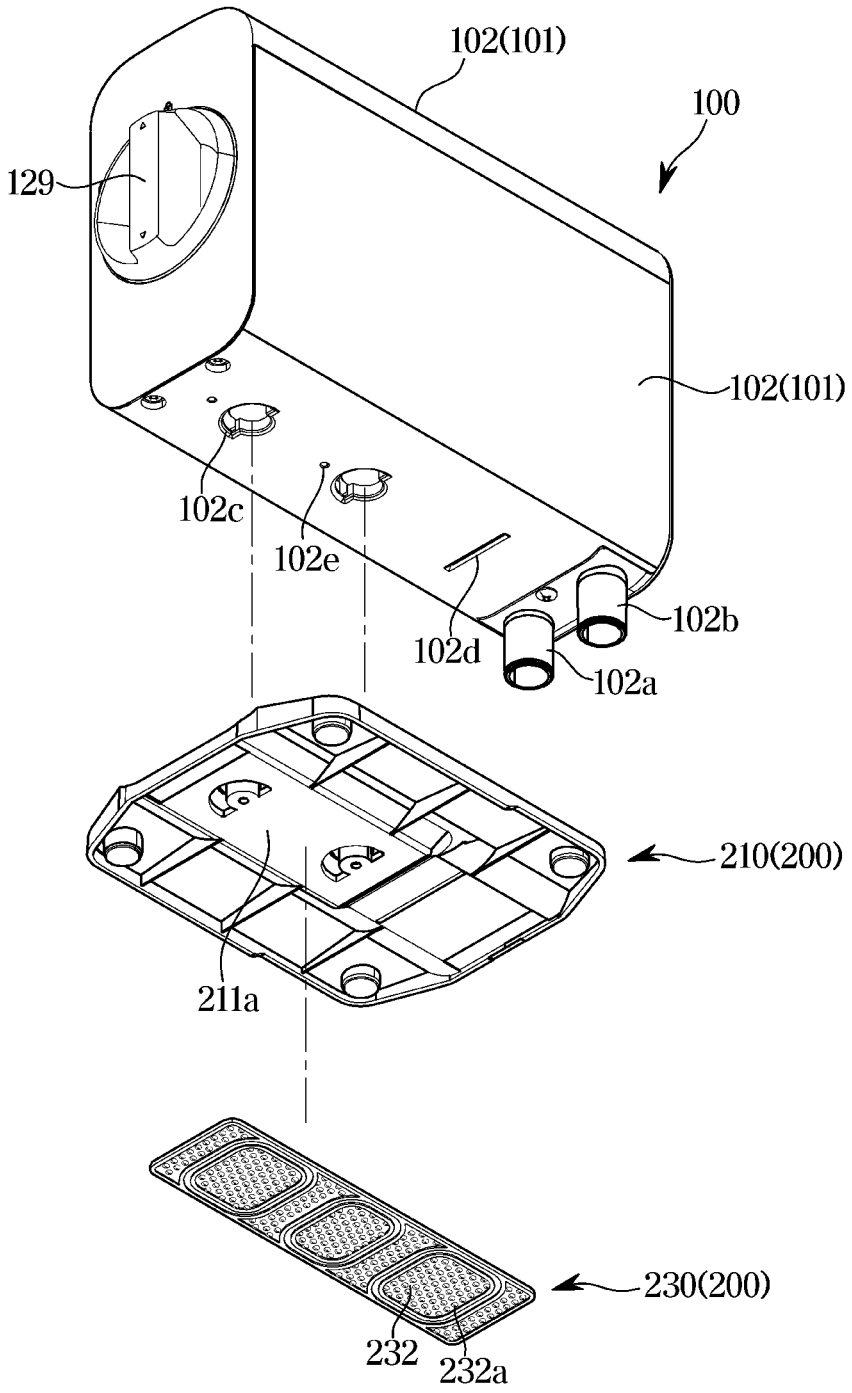
FIG. 14 illustrates a state in which the filter device of the clothes treating apparatus according to an embodiment of the disclosure is mounted on the upper surface of the washing machine through the installation device, when viewed from a direction different from FIG. 13.
Figure 15:
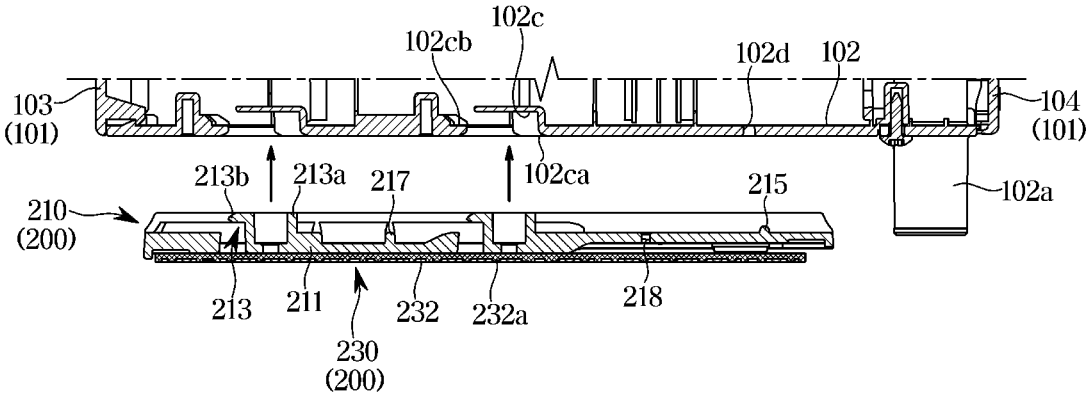
FIG. 15 illustrates a state before the installation device is coupled to the filter device according to an embodiment of the disclosure.
Figure 16:
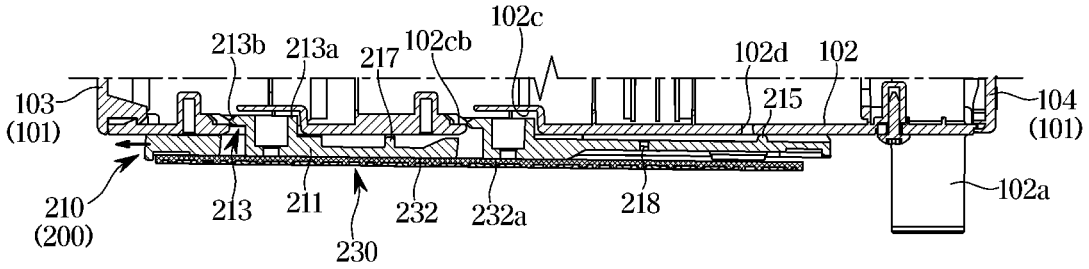
FIG. 16 illustrates a state in which the installation device is coupled to the filter device according to an embodiment of the disclosure.
Figure 17:
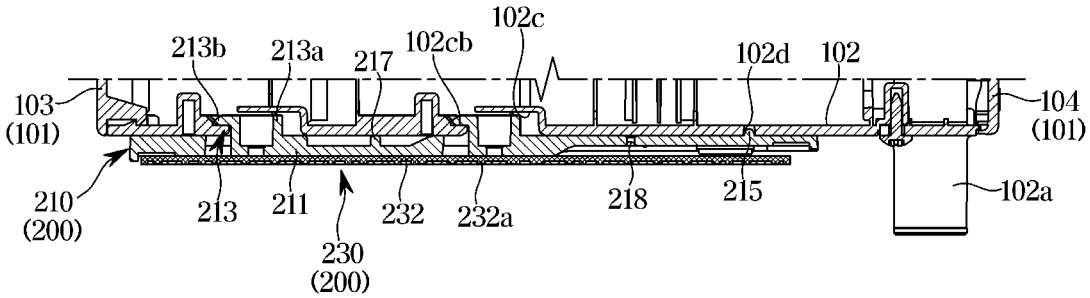
FIG. 17 illustrates a state in which the installation device is fixed to the filter device according to an embodiment of the disclosure.

FIG. 13 illustrates a state in which the filter device of the clothes treating apparatus according to an embodiment of the disclosure is mounted on an upper surface of the washing machine through an installation device. FIG. 14 illustrates a state in which the filter device of the clothes treating apparatus according to an embodiment of the disclosure is mounted on the upper surface of the washing machine through the installation device, when viewed from a direction different from FIG. 13. FIG. 15 illustrates a state before the installation device is coupled to the filter device according to an embodiment of the disclosure. FIG. 16 illustrates a state in which the installation device is coupled to the filter device according to an embodiment of the disclosure. FIG. 17 illustrates a state in which the installation device is fixed to the filter device according to an embodiment of the disclosure.

Referring to FIGS. 13 and 14, the clothes treating apparatus 1 or 1*a* may include an installation device 200 for installing the filter device 100. According to an embodiment, the installation device 200 may be used to install the filter device 100 on the upper surface of the washing machine 10 as shown in FIG. 1 or on an upper surface of a shelf.

The installation device 200 may include a supporter 210. The supporter 210 may be removably coupled to the filter device 100. The supporter 210 may be removably coupled to the filter housing 101 of the filter device 100. The supporter 210 may be removably coupled to the housing body 102 of the filter housing 101.

The filter device 100 may include a coupler 102*c* to which the supporter 210 is removably coupled. The coupler 102*c* may be provided on the housing body 102 of the filter housing 101. The coupler 102*c* may be located on a bottom surface of the filter device 100. The coupler 102*c* may have a substantially groove shape. For example, the coupler 102*c* may be provided in plurality. In order to be coupled to a supporter mounting portion 213 of the supporter 210, the filter device 100 includes the coupler 102*c* formed on the bottom surface of the filter device 100.

The supporter 210 may include a supporter body 211 having a substantially plate shape. The supporter body 211 may be provided to have a length greater than a width of the filter device 100 while the supporter 210 is directly coupled to the filter device 100. The supporter body 211 may support the filter device 100 to prevent the filter device 100 from tipping over while the supporter 210 is mounted on the upper surface of the washing machine 10 in a state in which the supporter 210 is directly coupled to the filter device 100.

The supporter 210 may include the supporter mounting portion 213 to be removably coupled to the coupler 102*c* of the filter device 100. The supporter mounting portion 213 may have a shape that protrudes from the supporter body 211 to correspond to the coupler 102*c* of the filter device 100. For example, the supporter mounting portion 213 may be provided in a number corresponding to the number of couplers 102*c*.

Referring to FIGS. 14 and 15, the coupler 102*c* of the filter device 100 may include a passing portion 102*ca* through which at least a portion of the supporter mounting portion 213 of the supporter 210 passes. The passing portion 102*ca* may be formed to allow a fixing body 213*b* of the supporter mounting portion 213 to pass therethrough. The passing portion 102*ca* may include a portion having a shape corresponding to the fixing body 213*b* of the supporter mounting portion 213.

The coupler 102*c* of the filter device 100 may include a coupling support portion 102*cb* for supporting and fixing a portion of the supporter mounting portion 213 passing through the passing portion 102*ca*. The coupling support portion 102*cb* may be provided to support the fixing body 213*b* of the supporter mounting portion 213 passing through the passing portion 102*ca*. The coupling support portion 102*cb* may be located adjacent to the passing portion 102*ca*.

The supporter mounting portion 213 of the supporter 210 may include a mounting body 213*a* and the fixing body 213*b* protruding from the mounting body 213*a*. The mounting body 213*a* may protrude from the supporter body 211. The mounting body 213*a* may have a substantially cylindrical shape.

The fixing body 213*b* may be located at an end of the mounting body 213*a* that is spaced apart from the supporter body 211. The fixing body 213*b* may protrude from the mounting body 213*a* in a direction different from a direction in which the mounting body 213*a* protrudes. The fixing body 213*b* may protrude in a radial direction of the mounting body 213*a*. The fixing body 213*b* may be provided to pass through the passing portion 102*ca*. The fixing body 213*b* may be supported and fixed by the coupling support portion 102*cb* after passing through the passing portion 102*ca*.

The filter device 100 may include a supporter fixing portion 102*d* for fixing the coupled state with the supporter 210. The supporter fixing portion 102*d* may be provided on the housing body 102 of the filter housing 101. The supporter fixing portion 102*d* may have a substantially slit shape. The supporter fixing portion 102*d* may be positioned spaced apart from the coupler 102*c*.

The supporter 210 may include a fixed support portion 215 provided to be coupled to the supporter fixing portion 102*d* of the filter device 100. The fixed support portion 215 may be provided to correspond to the shape of the supporter fixing portion 102*d*. The fixed support portion 215 may protrude from the supporter body 211. The fixed support portion 215 may be positioned spaced apart from the supporter mounting portion 213.

As the supporter 210 slides with respect to the filter device 100 after the supporter mounting portion 213 is inserted into the coupler 102*c*, the fixing body 213*b* may be coupled to the coupling support portion 102*cb*, and the fixed support portion 215 may be inserted into the supporter fixing portion 102*d*. As the fixed support portion 215 is inserted into the supporter fixing portion 102*d*, it is possible to prevent the supporter 210 from moving in a direction away from the filter device 100.

The supporter 210 may include a material having elasticity. As the fixed support portion 215 is separated from the supporter fixing portion 102*d* and the supporter 210 is moved in a direction opposite to the mounting direction of the supporter 210, the supporter mounting portion 213 may be separated from the coupler 102*c* and the supporter 210 may be separated from the filter device 100.

The installation device 200 may include a buffer member 230. The buffer member 230 may be provided to reduce vibration, which may occur in the washing machine 10, from being transmitted to the filter device 100 while the supporter 210 mounted on the filter device 100 is directly installed in the washing machine 10.

The supporter 210 may include a mounting surface 211*a* on which the buffer member 230 is mounted. The mounting surface 211*a* may be located on a surface opposite to a surface on which the supporter mounting portion 213 of the supporter 210 is located.

The buffer member 230 may include a material that is more flexible than the supporter 210. The buffer member 230 may include a material having an adhesive force. The buffer member 230 may be removably attached to the supporter 210. The buffer member 230 may be removably attached to the washing machine 10.

The buffer member 230 may include a first surface 231 to be attached to the supporter 210 and a second surface 232 to be attached to the washing machine 10. The first surface 231 may be formed to be substantially flat. The buffer member 230 may include a protrusion 232*a* protruding from the second surface 232.

Because the buffer member 230 is provided with the protrusion 232*a* on the second surface 232, a frictional force and/or adhesive force of the first surface 231 in contact with the supporter 210 may be greater than a friction force and/or adhesive force of the second surface 232 in contact with the washing machine 10. Because the friction and/or adhesive force between the first surface 231 of the buffer member 230 and the supporter 210 is greater than the friction and/or adhesive force between the second surface 232 of the buffer member 230 and the washing machine 10, the buffer member 230 in a state of being attached to the supporter 210 may be separated from the washing machine 10 when the filter device 100 mounted on the installation device 200 is separated from the washing machine 10.

A method of mounting the filter device 100 on the upper surface of the washing machine 10 will be described with reference to FIGS. 15 to 17.

Referring to FIGS. 15 and 16, the first surface 231 of the buffer member 230 may be attached to the surface of the supporter 210 opposite to the surface that is mounted on the filter device 100. The supporter 210, to which the buffer member 230 is attached, may be aligned to allow the fixing body 213*b* of the supporter mounting portion 213 to pass through the passing portion 102*ca* of the coupler 102*c*, and then the supporter 210 may be primarily coupled to the filter device 100.

Referring to FIGS. 16 and 17, in a state in which the fixing body 213*b* of the supporter mounting portion 213 passes through the passing portion 102*ca* of the coupler 102*c*, the supporter 210 may slide with respect to the filter device 100. Accordingly, the fixing body 213*b* of the supporter mounting portion 213 may be coupled to the coupling support portion 102*cb* and may be supported by the coupling support portion 102*cb*.

In a state in which the fixing body 213*b* of the supporter mounting portion 213 is supported by the coupling support portion 102*cb*, the fixed support portion 215 of the supporter 210 may be coupled to the supporter fixing portion 102*d* of the filter device 100. In a state in which the fixing body 213*b* of the supporter mounting portion 213 is supported by the coupling support portion 102*cb*, the fixed support portion 215 of the supporter 210 may be coupled to the supporter fixing portion 102*d* of the filter device 100. Accordingly, the installation device 200 may be mounted and fixed to the filter device 100.

With this configuration, the installation device 200 according to an embodiment of the disclosure may be easily mounted on the filter device 100 and easily separated from the filter device 100, thereby improving the installation efficiency of the filter device 100 and improving the usability of the filter device 100.

Figure 18:
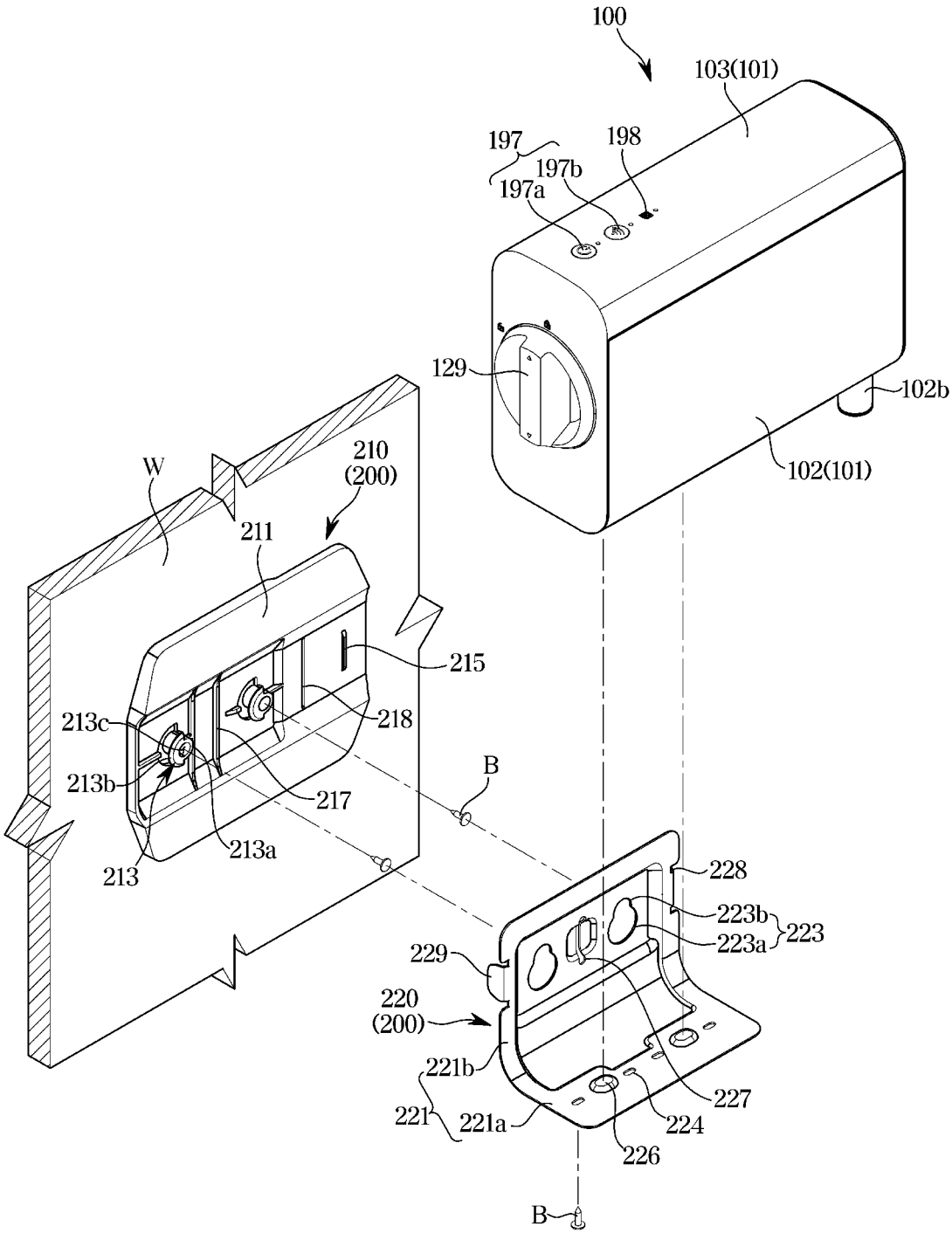
FIG. 18 illustrates a state in which the filter device of the clothes treating apparatus according to an embodiment of the disclosure is mounted on a side wall through the installation device.
Figure 19:
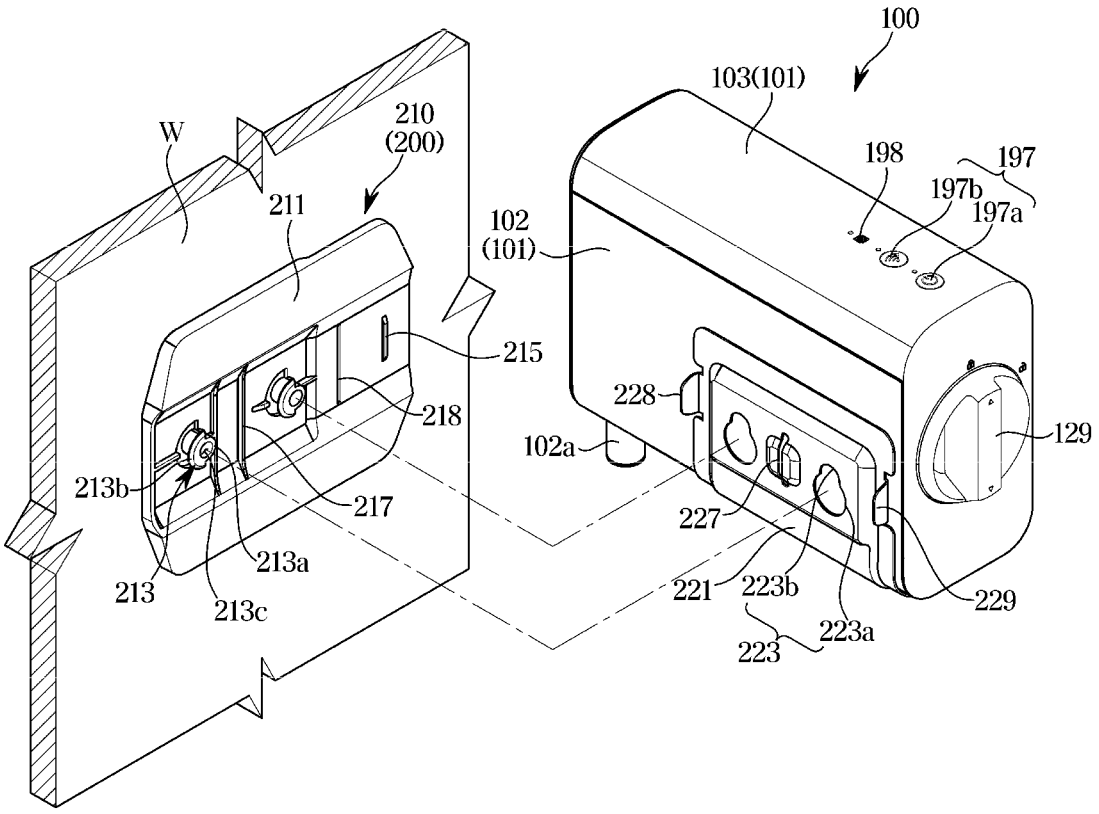
FIG. 19 illustrates a state before a support bracket is coupled to a supporter of the installation device according to an embodiment of the disclosure.
Figure 20:
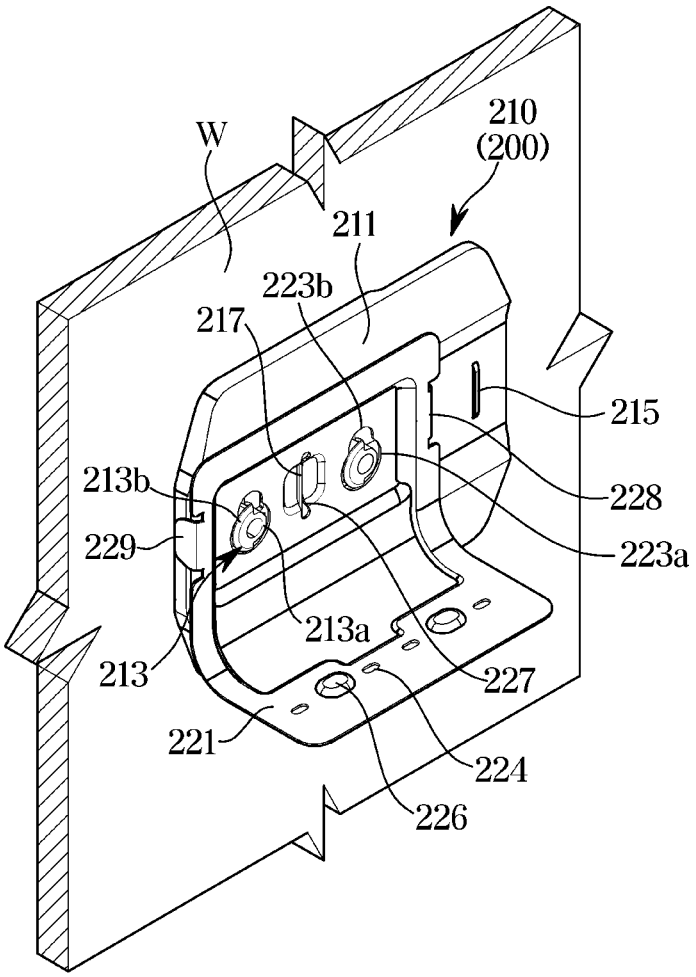
FIG. 20 illustrates a state in which the support bracket is coupled to the supporter of the installation device according to an embodiment of the disclosure.
Figure 21:
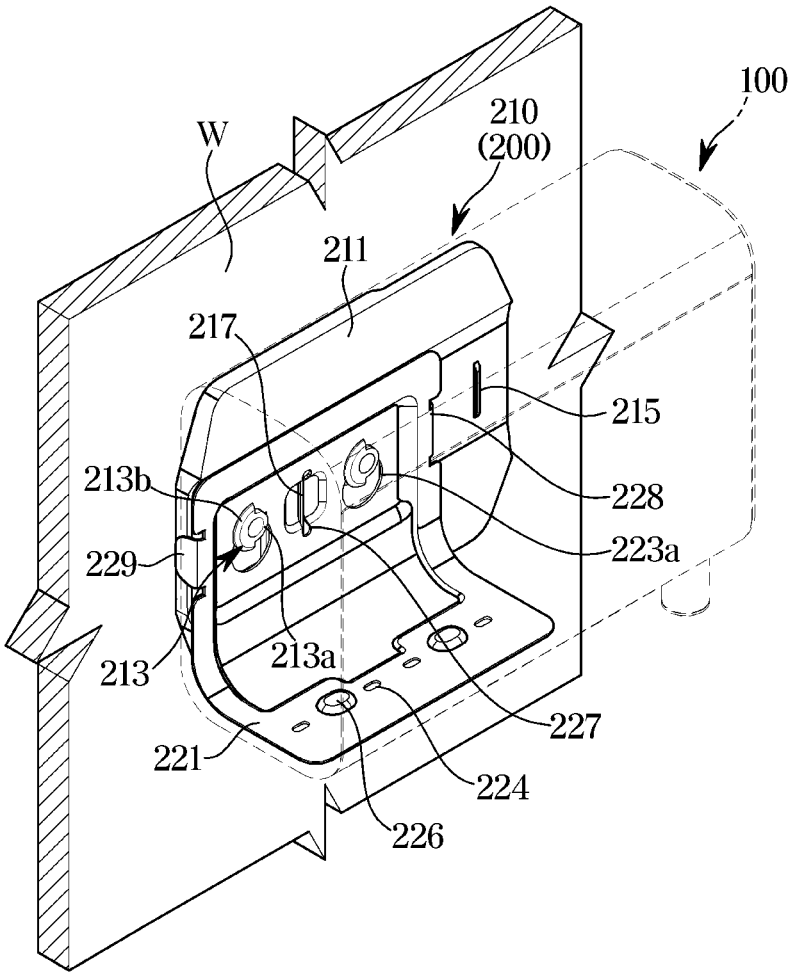
FIG. 21 illustrates a state in which the support bracket is fixed to the supporter according to an embodiment of the disclosure.

FIG. 18 illustrates a state in which the filter device of the clothes treating apparatus according to an embodiment of the disclosure is mounted on a side wall through the installation device. FIG. 19 illustrates a state before a support bracket is coupled to a supporter of the installation device according to an embodiment of the disclosure. FIG. 20 illustrates a state in which the support bracket is coupled to the supporter of the installation device according to an embodiment of the disclosure. FIG. 21 illustrates a state in which the support bracket is fixed to the supporter according to an embodiment of the disclosure.

Referring to FIG. 18, the installation device 200 of the clothes treating apparatus 1 or 1*a* may be provided to install the filter device 100 on a side wall W and/or the side surface of the washing machine 10 or 10*a*. According to an embodiment, the installation device 200 may be used to install the filter device 100 on a surface of the side wall W adjacent to the washing machine 10*a*, as shown in FIG. 4.

The supporter 210 of the installation device 200 according to an embodiment may support the filter device 100 by being directly coupled to the filter device 100 when the filter device 100 is mounted on the upper surface of the washing machine 10, as shown in FIG. 1. The supporter 210 of the installation device 200 according to an embodiment may support the filter device 100 by being indirectly coupled to the filter device 100 when the filter device 100 is mounted on the side wall W adjacent to the washing machine 10*a*, as shown in FIG. 4.

The supporter 210 of the installation device 200 according to an embodiment may support the filter device 100 by being coupled to a support bracket 220 mounted on the filter device 100. The supporter 210 may be removably mounted on the support bracket 220. The supporter 210 of the installation device 200 according to an embodiment may be removably mounted on the filter device 100 or may be removably mounted on the support bracket 220.

The installation device 200 according to an embodiment may include the support bracket 220 provided to be removably mounted on the supporter 210. The support bracket 220 may be removably coupled to the filter device 100.

The support bracket 220 may include a bracket body 221 having a substantially L-shape. The bracket body 221 may include a bottom portion 221*a* provided to face the bottom surface of the filter device 100 when the bracket body 221 is coupled to the filter device 100, and a side portion 221*b* provided to face the left surface or the right surface of the filter device 100 when the bracket body 221 is coupled to the filter device 100. The bottom portion 221*a* of the bracket body 221 may support the filter device 100. According to the position of the side wall W, the support bracket 220 may be coupled to the filter device 100 to allow the side portion 221*b* to face the left surface of the filter device 100 or to allow the side portion 221*b* to face the right surface of the filter device 100.

The support bracket 220 may include an insertion portion 226 provided to be inserted into the coupler 102*c* of the filter device 100. The insertion portion 226 may have a shape that protrudes from the bracket body 221. The insertion portion 226 may be inserted into the coupler 102*c* while the support bracket 220 is mounted on the filter device 100. The insertion portion 226 may be provided in a number corresponding to the number of couplers 102*c*. The insertion portion 226 may guide a position of the support bracket 220 relative to the filter device 100 to allow a fastening member B to be coupled to a fastening hole 224 of the support bracket 200 and a fastening hole 102*e* (refer to FIG. 14) of the filter device 100.

The support bracket 220 may include the fastening hole 224 for being fixed to the filter device 100 by the fastening member B. In a state in which the support bracket 220 is positioned relative to the filter device 100 to allow the insertion portion 226 to be inserted into the coupler 102*c*, the fastening member B may be coupled to the fastening hole 224 of the support bracket 220 and the fastening hole 102*e* of the filter device 100. Accordingly, the support bracket 220 may be fixed to the filter device 100.

The support bracket 220 may include a bracket coupler 223 to which the supporter mounting portion 213 of the supporter 210 is removably coupled. The bracket coupler 223 may be provided in a number corresponding to the number of supporter mounting portions 213.

The bracket coupler 223 may include a bracket passing portion 223*a* through which at least a portion of the supporter mounting portion 213 of the supporter 210 passes. The bracket passing portion 223*a* may be provided to allow the fixing body 213*b* of the supporter mounting portion 213 to pass therethrough.

The bracket coupler 223 may include a bracket support portion 223*b* for supporting and fixing a portion of the supporter mounting portion 213 passing through the bracket passing portion 223*a*. The bracket support portion 223*b* may be located adjacent to the bracket passing portion 223*a*. The bracket support portion 223*b* may be located above the bracket passing portion 223*a* with respect to the direction of gravity. The bracket support portion 223*b* may have a smaller size than the bracket passing portion 223*a*. The bracket support portion 223*b* may be provided to prevent the fixing body 213*b* of the supporter mounting portion 213 from passing therethrough.

The support bracket 220 may be mounted on the supporter 210 as the fixing body 213*b* of the supporter mounting portion 213 passes through the bracket passing portion 223*a* and then slides against the supporter 210 in the direction of gravity. When the support bracket 220 is mounted on the supporter 210, the mounting body 213*a* may support the bracket support portion 223*b* in the direction of gravity, and the fixing body 213*b* may support the side portion 221*b* of the support bracket 220 in a direction opposite to a direction in which the support bracket 220 is separated from the supporter 210. Therefore, it is possible to prevent the support bracket 220 from being separated from the supporter 210.

The supporter 210 may include a supporter rib 217 configured to limit a relative movement of the support bracket 220 with respect to the supporter 210 while the supporter 210 is coupled to the support bracket 220. The supporter rib 217 may be located adjacent to the supporter mounting portion 213. The supporter rib 217 may extend in the direction in which the support bracket 220 is mounted on the supporter 210.

The support bracket 220 may include a bracket groove 227 coupled to the supporter rib 217 while the support bracket 220 is mounted on the supporter 210. The supporter rib 217 may be inserted into the bracket groove 227 while the support bracket 220 is mounted on the supporter 210. The bracket groove 227 may extend in the direction in which the support bracket 220 is mounted on the supporter 210.

As the supporter rib 217 of the supporter 210 is inserted into the bracket groove 227 of the support bracket 220, the relative movement of the support bracket 220 with respect to the supporter 210 may be limited. By the supporter rib 217 and the bracket groove 227, it is possible to prevent the support bracket 220 from moving relative to the supporter 210 in a direction that is perpendicular to the direction of gravity and the direction in which the support bracket 220 is separated from the supporter 210. By the supporter rib 217 and the bracket groove 227, it is possible to prevent the support bracket 220 from moving relative to the supporter 210 in the front and rear direction of the filter device 100.

The supporter 210 may include a supporter groove 218 provided to limit a relative movement of the support bracket 220 with respect to the supporter 210 while the support bracket 220 is coupled. The supporter groove 218 may extend approximately parallel to the supporter rib 217. The supporter groove 218 may extend in the direction of gravity.

The support bracket 220 may include bracket ribs 228 and 229 coupled to the supporter groove 218 while the support bracket 220 is coupled to the supporter 210. The bracket ribs 228 and 229 may be inserted into the supporter groove 218 while the support bracket 220 is mounted on the supporter 210. As the bracket ribs 228 and 229 of the support bracket 220 are inserted into the supporter groove 218 of the supporter 210, the relative movement of the support bracket 220 with respect to the supporter 210 may be limited.

The bracket ribs 228 and 229 may be provided at symmetrical positions with respect to the bracket groove 227. The bracket ribs 228 and 229 may be located at both ends of the side portion 221*b* of the bracket body 221.

As shown in FIG. 18, when the side wall W is located on the left side of the filter device 100, one bracket rib 228 among the plurality of bracket ribs 228 and 229 may be inserted into the supporter groove 218. Accordingly, the support bracket 220 may be mounted on the supporter 210. For example, when the side wall W is located on the right side of the filter device 100, the other bracket rib 229 among the plurality of bracket ribs 228 and 229 may be inserted into the support groove 218. Accordingly, the support bracket 220 may be mounted on the supporter 210.

A method of mounting the filter device 100 on the side wall W will be described with reference to FIGS. 18 to 21.

Referring to FIG. 18, in order to mount the filter device 100 on the side wall W, the supporter 210 may be mounted on the side wall W. The supporter 210 may be fixed to the side wall W by the fastening member B. The supporter 210 may include a fastening hole 213*c* for the fastening member B. The fastening hole 213*c* may be provided in the supporter mounting portion 213.

Referring to FIG. 19, the support bracket 220 may be mounted on the filter device 100. In the state in which the insertion portion 226 is inserted into the coupler 102*c*, the fastening member B may be fastened to the fastening hole 224 of the support bracket 220 and the fastening hole 102*e* of the filter device 100. Accordingly, the support bracket 220 may be mounted on the filter device 100.

Referring to FIG. 20, as the fixing body 213*b* of the supporter mounting portion 213 passes through the bracket passing portion 223*a* of the bracket coupler 223, the support bracket 220 may be primarily coupled to the supporter 210. The supporter rib 217 of the supporter 210 may be inserted into the bracket groove 227 of the support bracket 220. The bracket rib 228 of the support bracket 220 may be inserted into the supporter groove 218 of the supporter 210.

Referring to FIG. 21, as the support bracket 220 moves relative to the supporter 210 in the direction of gravity, the mounting body 213*a* of the supporter mounting portion 213 may be positioned in the bracket support portion 223*b* of the bracket coupler 223. The mounting body 213*a* of the supporter mounting portion 213 may support the support bracket 220 in the direction of gravity. The fixing body 213*b* of the supporter mounting portion 213 may support the support bracket 220 in a direction opposite to the direction in which the support bracket 220 is separated from the supporter 210.

The installation device 200 according to an embodiment may include the supporter 210, the support bracket 220, and the buffer member 230. The installation device 200 according to an embodiment may include the supporter 210 and the buffer member 230. The installation device 200 according to an embodiment may include the supporter 210 and the support bracket 220.

When the filter device 100 is mounted on the washing machine 10 or 10*a*, the installation device 200 may include the buffer member 230 to absorb vibration from the washing machine 10 or 10*a*.

When the filter device 100 is mounted on the side wall W or the side surface of the washing machine 10 or 10*a*, the installation device 200 may include the support bracket 220.

With this configuration, the installation device 200 according to an embodiment may mount the filter device 100 on the upper surface of the washing machine 10 or 10*a* or the upper surface of a shelf, as needed. Further, the installation device 200 may mount the filter device 100 on the side surface such as the side surface of the washing machine 10 or 10*a* or the side wall W, and thus the installation efficiency of the filter device 100 may be improved and the usability of the filter device 100 may be improved.

According to an embodiment, the clothes treating apparatus 1 or 1*a* may include the housing 11 or 11*a*, the tub 20 or 20*a* inside the housing, the drainage device 70 or 70*a* configured to discharge water from the tub to the outside of the housing, the filter device 100 configured to be disposed outside the housing, and connected to the drainage device to receive the water discharged by the drainage device and filter out foreign substances from the received water, the filter device including a coupler on a bottom of the filter device, and the installation device 200 configured to mount the filter device to a surface, the installation device including the supporter 210, and the supporter including the supporter mounting portion 213. The installation device is configured so that: the supporter is seatable to the surface, and the supporter mounting portion is couplable to the coupler 102*c* so that, while the supporter is seated to the surface and the supporter mounting portion is coupled to the coupler, the filter device is mounted to the surface. With this configuration, the clothes treating apparatus according to an embodiment may easily mount the filter device. With this configuration, the clothes treating apparatus according to an embodiment may improve the usability of the filter device.

The installation device may include the buffer member 230 configured to absorb vibration that is transmitted from the clothes treating apparatus to the filter device. With this configuration, the clothes treating apparatus according to an embodiment may reduce damage to the filter device due to vibration generated in the washing machine, even when the filter device is mounted in the washing machine.

The buffer member may include a material having an adhesive force. With this configuration, the clothes treating apparatus according to an embodiment may omit a separate configuration for mounting the installation device to the washing machine.

The buffer member may include the first side 231 attached to the installation device, and the second side 232 configured to be attached to the surface, and configured so that a friction force between the second side and the surface is less than a friction force between the first side and the installation device. With this configuration, the clothes treating apparatus according to an embodiment may easily separate the installation device from the washing machine.

The buffer member may include the protrusion 232*a* formed on a side configured to be in contact with the surface.

The filter device may include the supporter fixing portion 102*d* on the bottom of the filter device. The supporter may include the fixed support portion 215 configured to be coupled to the supporter fixing portion 102*d* to limit a movement of the supporter relative to the filter device while the supporter mounting portion is coupled to the coupler. With this configuration, the clothes treating apparatus according to an embodiment may reduce shaking of the filter device when the filter device is mounted on the washing machine through the supporter.

The installation device may include the support bracket 220 configured to be couplable to the filter device and to be couplable to the supporter. With this configuration, the clothes treating apparatus according to an embodiment may mount the filter device in various positions, thereby improving the usability of the filter device.

The support bracket may include the insertion portion 226 configured to be inserted into the coupler, and a first fastening hole configured to receive a fastening member. The filter device may include a second fastening hole configured to receive the fastening member. As the fastening member B is received in the first fastening hole 224 of the support bracket and the second fastening hole 102*e* of the filter device while the insertion portion is inserted into the coupler, the support bracket may be coupled to the filter device. With this configuration, the clothes treating apparatus according to an embodiment may easily mount the support bracket to the filter device.

The support bracket may include the bracket coupler 223 configured to be coupled to the supporter mounting portion of the supporter.

The supporter may include the supporter rib 217 extending laterally in a direction in which the support bracket is couplable to the supporter. The support bracket may include the bracket groove 227 into which the supporter rib is inserted while the support bracket is coupled to the supporter. With this configuration, the clothes treating apparatus according to an embodiment may reduce the shaking of the filter device that is mounted on the supporter through the support bracket.

The support bracket may include the plurality of bracket ribs provided to be symmetrical with respect to the bracket groove. The supporter may include the supporter groove 218 into which allow one bracket rib among the plurality of bracket ribs is inserted while the supporter rib is inserted into the bracket groove. With this configuration, the clothes treating apparatus according to an embodiment may mount the filter device in various positions.

The support bracket may include the bottom portion 221*a* to support a portion of the bottom of the filter device while the support bracket is coupled to the filter device, and the side portion 221*b* to cover a portion of the left side or the right side of the filter device while the support bracket is coupled to the filter device.

The support bracket may be configured to be coupled to the supporter in a sliding movement. With this configuration, the clothes treating apparatus according to an embodiment may mount the filter device in a relatively simple manner.

The supporter may be configured to be coupled to the filter device in a sliding movement. With this configuration, the clothes treating apparatus according to an embodiment may mount the filter device in a relatively simple manner.

The supporter may include the fastening hole 213*c* in the supporter mounting portion to receive the fastening member B. With this configuration, the clothes treating apparatus according to an embodiment may form a neat appearance when the supporter is installed on the side wall.

According to an embodiment, the clothes treating apparatus 1 or 1*a* may include the washing machine 10 or 10*a* including the washing machine housing 11 or 11*a*, the tub 20 or 20*a* arranged inside the washing machine housing, and the drainage device 70 or 70*a* configured to discharge water of the tub to the outside of the washing machine housing, the filter device 100 disposed outside the washing machine housing, and configured to be connected to the drainage device to filter out foreign substances from water discharged from the washing machine, and the installation device 200 provided to mount the filter device. The installation device may include the support bracket 220 configured to be removably coupled to the filter device, and the supporter 210 configured to be removably mounted on the support bracket and configured to be removably mounted on the filter device. With this configuration, the clothes treating apparatus according to an embodiment may easily mount the filter device. With this configuration, the clothes treating apparatus according to an embodiment may improve the usability of the filter device.

The installation device may further include the buffer member 230 configured to absorb vibration that is transmitted from the washing machine to the filter device. With this configuration, the clothes treating apparatus according to an embodiment may reduce damage to the filter device due to vibration generated in the washing machine, even when the filter device is mounted on the washing machine.

The buffer member may include the protrusion 232*a* formed on a surface provided to be in contact with the washing machine. With this configuration, the clothes treating apparatus according to an embodiment may easily separate the installation device from the washing machine.

The supporter may include the supporter mounting portion 213. The filter device may include the coupler 102*c* configured to be removably coupled to the supporter mounting portion. The support bracket may include the bracket coupler 223 configured to be removably coupled to the supporter mounting portion. With this configuration, the clothes treating apparatus according to an embodiment may mount the filter device in various positions.

The supporter may have a size greater than a width of the filter device to prevent tipping over while the supporter is mounted on the filter device. With this configuration, the clothes treating apparatus according to an embodiment may prevent the filter device from tipping over while the filter device is mounted on the upper surface of the washing machine or the upper surface of the shelf.

As is apparent from the above description, a clothes treating apparatus may include an installation device provided to mount a filter device in a relatively simple manner, and thus the installation efficiency of the filter device may be improved.

Further, a clothes treating apparatus may allow a filter device to be mounted on a position adjacent to a washing machine by using an installation device, and thus the usability of the filter device may be improved.

Additional aspects of the disclosure will be set forth in part in the description which follows and, in part, will be obvious from the description, or may be learned by practice of the disclosure.

While the present disclosure has been particularly described with reference to exemplary embodiments, it should be understood by those of skilled in the art that various changes in form and details may be made without departing from the spirit and scope of the present disclosure.

The invention claimed is:

1. A clothes treating apparatus comprising:

a housing, a tub inside the housing, a drainage device including a pump, the drainage device configured to discharge water from the tub to an outside of the housing;

a filter device including a filter, and a coupler including a passing portion and a coupling support portion on a bottom of the filter device, the filter device outside the housing and connectable to the drainage device, and configured to receive the water discharged by the drainage device and filter out foreign substances from the received water; and an installation device including a supporter that is seatable on a surface external to the housing and couplable to the filter device, the supporter including a supporter mounting portion that is passable through the passing portion and supportable on the coupling support portion, wherein the supporter mounting portion includes a mounting body and a fixing body that protrudes from the mounting body, and the filter device and the installation device are configured such that:

with the supporter seated on the surface, the mounting body passed through the passing portion, and the fixing body supported on the coupling support portion, the installation device is coupled to the coupler and the filter device is mounted to the surface.

2. The clothes treating apparatus of claim 1, wherein the installation device includes a buffer member configured to absorb vibration that is transmitted from the clothes treating apparatus to the filter device.

3. The clothes treating apparatus of claim 2, wherein the buffer member includes a material having an adhesive force.

4. The clothes treating apparatus of claim 2, wherein the buffer member includes:

a first side attached to the installation device, and a second side configured to be attached to the surface, and configured so that a friction force between the second side and the surface is less than a friction force between the first side and the installation device.

5. The clothes treating apparatus of claim 2, wherein the buffer member includes a protrusion formed on a side configured to be in contact with the surface.

6. The clothes treating apparatus of claim 1, wherein the filter device includes a supporter fixing portion on the bottom of the filter device, and the supporter includes a fixed support portion configured to be coupled to the supporter fixing portion to limit a movement of the supporter relative to the filter device while the supporter mounting portion is coupled to the coupler.

7. The clothes treating apparatus of claim 1, wherein the filter device further includes a support bracket configured to be couplable to the supporter, and the support bracket includes a bracket coupler including the passing portion and a bracket support portion that supports a portion of the supporter mounting portion passing through the passing portion.

8. The clothes treating apparatus of claim 7, wherein the support bracket further includes:

an insertion portion configured to be inserted into the filter device, and a first fastening hole configured to receive a fastening member, the filter device further includes:

a second fastening hole configured to receive the fastening member, and with the insertion portion inserted into the filter device, the fastening member received in the first fastening hole and the second fastening hole, the support bracket is coupled to the filter device.

9. The clothes treating apparatus of claim 7, wherein the support bracket includes a bottom portion that is couplable to the filter device and a side portion that includes the bracket coupler and that is couplable to the supporter mounting portion.

10. The clothes treating apparatus of claim 7, wherein the supporter further includes a supporter rib extending laterally in a direction in which the support bracket is couplable to the supporter, and the support bracket includes a bracket groove into which the supporter rib is inserted with the support bracket is-coupled to the supporter.

11. The clothes treating apparatus of claim 10, wherein the support bracket includes a plurality of bracket ribs that are symmetrical with respect to the bracket groove, and the supporter includes a supporter groove into which one bracket rib among the plurality of bracket ribs is inserted with the supporter rib inserted into the bracket groove.

12. The clothes treating apparatus of claim 7, wherein the support bracket includes:

a bottom portion to support a portion of the bottom of the filter device while the support bracket is coupled to the filter device, and a side portion to cover a portion of a side of the filter device with the support bracket coupled to the filter device.

13. The clothes treating apparatus of claim 7, wherein the support bracket is configured to be coupled to the supporter in a sliding movement.

14. The clothes treating apparatus of claim 1, wherein the supporter is configured to be coupled to the filter device in a sliding movement.

15. The clothes treating apparatus of claim 1, wherein the supporter includes a fastening hole in the supporter mounting portion to receive a fastening member.

16. The clothes treating apparatus of claim 1, wherein the mounting body protrudes from the supporter in a first direction and the fixing body protrudes from the mounting body in a second direction different from the first direction, the filter device is slidable relative to the installation device, and the filter device and the installation device are further configured such that:

with the supporter seated on the surface, the mounting body passed through the passing portion in the first direction, and the filter device slid relative to the installation device in the second direction, the fixing body is supported on the coupling support portion, the installation device is coupled to the coupler, and the filter device is mounted to the surface.

17. The clothes treating apparatus of claim 1, wherein the filter device includes a filter device housing and the coupler is on the filter device housing.

18. A clothes treating apparatus comprising:

a housing, a tub inside the housing, a drainage device including a pump, the drainage device configured to discharge water from the tub to an outside of the housing;

a filter device including a filter, and a coupler including a passing portion and a coupling support portion on a bottom of the filter device, the filter device outside the housing and connectable to the drainage device, and configured to receive the water discharged by the drainage device and filter out foreign substances from the received water; and an installation device including a supporter that is seatable on a surface external to the housing and couplable to the filter device, the supporter including a supporter mounting portion that is passable through the passing portion and supportable on the coupling support portion, wherein the supporter mounting portion includes a mounting body that protrudes from the supporter in a first direction and a fixing body that protrudes from the mounting body in a second direction different from the first direction, and the filter device and the installation device are configured such that:

with the supporter seated on the surface, the mounting body passed through the passing portion, and the fixing body supported on the coupling support portion, the installation device is coupled to the coupler and the filter device is mounted to the surface.

19. The clothes treating apparatus of claim 18, wherein the installation device includes a support bracket configured to be couplable to the supporter, and the support bracket includes a bracket coupler including the passing portion and a bracket support portion that supports a portion of the supporter mounting portion passing through the passing portion.

20. The clothes treating apparatus of claim 18, wherein the filter device is slidable relative to the installation device, and the filter device and the installation device are further configured such that: with the supporter seated on the surface, the mounting body passed through the passing portion in the first direction, and the filter device slid relative to the installation device in the second direction, the fixing body is supported on the coupling support portion, the installation device is coupled to the coupler, and the filter device is mounted to the surface.

* * * * *